US008595868B2

(12) United States Patent
Fukagawa et al.

(10) Patent No.: US 8,595,868 B2
(45) Date of Patent: Dec. 3, 2013

(54) AIR SUCTION DEVICE FOR TOILET DRAIN PASSAGE

(75) Inventors: Masafumi Fukagawa, Chita (JP); Ken Higuchi, Tokoname (JP)

(73) Assignee: LIXIL Corporation, Tokyo (JP)

( * ) Notice: Subject to any disclaimer, the term of this patent is extended or adjusted under 35 U.S.C. 154(b) by 840 days.

(21) Appl. No.: 12/678,031

(22) PCT Filed: Sep. 16, 2008

(86) PCT No.: PCT/JP2008/066647
§ 371 (c)(1),
(2), (4) Date: Mar. 12, 2010

(87) PCT Pub. No.: WO2009/038040
PCT Pub. Date: Mar. 26, 2009

(65) Prior Publication Data

US 2010/0251473 A1 Oct. 7, 2010

(30) Foreign Application Priority Data

| | | |
|---|---|---|
| Sep. 21, 2007 | (JP) | 2007-244741 |
| Oct. 3, 2007 | (JP) | 2007-259410 |
| Oct. 15, 2007 | (JP) | 2007-268368 |
| Oct. 15, 2007 | (JP) | 2007-268369 |
| Feb. 25, 2008 | (JP) | 2008-042850 |

(51) Int. Cl.
*E03D 11/02* (2006.01)
*E03D 11/08* (2006.01)

(52) U.S. Cl.
USPC ..... 4/421

(58) Field of Classification Search
USPC ..... 4/421, 424, 328, 431
See application file for complete search history.

(56) References Cited

U.S. PATENT DOCUMENTS

| | | | | |
|---|---|---|---|---|
| 569,341 | A | 8/1896 | Madden | |
| 4,115,883 | A * | 9/1978 | Dauvergne | 4/353 |

(Continued)

FOREIGN PATENT DOCUMENTS

| | | | |
|---|---|---|---|
| CN | 2506715 | Y | 8/2002 |
| EP | 1 832 688 | A1 | 9/2007 |

(Continued)

OTHER PUBLICATIONS

International Search Report for PCT/JP2008/066647 dated Dec. 2, 2008 (English and JP language version).

(Continued)

*Primary Examiner* — Huyen Le
(74) *Attorney, Agent, or Firm* — Smith, Gambrell and Russell, LLP

(57) ABSTRACT

An air suction device for a toilet drain passage includes a suction tank partitioned by a diaphragm into an upper chamber and a lower chamber communicating with the passage, and an electromagnetic drive device moving the diaphragm upward. The drive device has a cylindrical case body installed away from the tank, a moving member housed in the case body so as to be vertically movable, and a moving device located on a lower end of the case body. The moving device has a casing and an actuator assembled in the casing to move the moving member. The case body has a first airtight chamber surrounded by the moving member and the moving device. The first airtight chamber has a cubic capacity changed by movement of the moving member and communicates with the first chamber. The first airtight chamber sucks air in the first chamber to move the diaphragm upward.

12 Claims, 17 Drawing Sheets

(56) References Cited

U.S. PATENT DOCUMENTS

| | | | | |
|---|---|---|---|---|
| 5,487,193 | A * | 1/1996 | Hennessy | 4/328 |
| 5,539,938 | A | 7/1996 | Tubbs | |
| 6,470,505 | B1 | 10/2002 | Boisvert | |
| 7,322,053 | B2 | 1/2008 | Whitehead | |
| 7,594,282 | B2 | 9/2009 | Shirai | |
| 8,142,572 | B2 | 3/2012 | Shirai et al. | |
| 2010/0088813 | A1 | 4/2010 | Onishi et al. | |

FOREIGN PATENT DOCUMENTS

| | | | |
|---|---|---|---|
| GB | 867664 | A | 5/1961 |
| GB | 2 121 079 | A | 12/1983 |
| JP | 5-311719 | A | 11/1993 |
| JP | 7-54388 | | 2/1995 |
| JP | 10-96255 | | 4/1998 |
| JP | 2004-143717 | | 5/2004 |
| JP | 2006-70617 | | 3/2006 |
| JP | 2006-112056 | | 4/2006 |
| JP | 2007-46307 | | 2/2007 |
| JP | 2007-46328 | | 2/2007 |
| JP | 2007-63980 | | 3/2007 |
| JP | 2007-224518 | | 9/2007 |
| WO | 2007-015403 | | 2/2007 |
| WO | 2007-015405 | | 2/2007 |

OTHER PUBLICATIONS

Extended European Search Report dated Jun. 28, 2011 for Application No. EP 08 83 2362.

* cited by examiner

AIR SUCTION DEVICE FOR TOILET DRAIN PASSAGE

BACKGROUND

1. Technical Field

The present invention relates to an air suction device for a toilet drain passage.

2. Related Art

FIG. 7 of Japanese Patent Application Publication JP-A-H05-311719 discloses a conventional air suction device for a toilet drain passage. The air suction device has a suction tank and a hydraulic drive unit, so that air is sucked from a toilet drain passage continuing to the downstream side of a water sealing section of toilet body.

The suction tank is provided with a first diaphragm movable in a vertical direction defined at the time of installation in a housing and is partitioned into an upper first chamber and a lower second chamber by the first diaphragm. The second chamber of the suction tank communicates with the toilet drain passage. The hydraulic drive unit has a second diaphragm to which tap water is supplied through a water conduit so that the second diaphragm is moved upward, and a bar-like member which is mounted on an upper surface of the second diaphragm and has a distal end connected to the first diaphragm.

In the suction device, tap water is supplied to the hydraulic drive device upon start of toilet flushing so that the second diaphragm is moved upward. Then the bar-like member drives the first diaphragm upward such that air in the toilet drain passage is sucked into the second chamber of the suction tank. As a result, since flush water is caused to flush into the toilet drain passage swiftly, a strong siphon action can be initiated at an early stage. Consequently, the siphon action can be initiated even by a smaller amount of flush water, and waste can be discharged out of the toilet body. Upon finish of the toilet flushing, tap water is discharged through the water conduit from the hydraulic drive unit, whereupon the first diaphragm is moved downward. As a result, the suction device can be prepared for next toilet flushing.

In the foregoing conventional suction device, however, the clogging of the water conduit results in an abnormal condition such as being unable to supply tap water into the hydraulic drive unit. When the second diaphragm is not moved upward, the first diaphragm cannot be moved upward such that an amount of air sucked from the toilet drain passage becomes insufficient. Since the siphon action cannot be initiated in this case, the toilet flushing would not be performed suitably. Furthermore, when tap water is not completely discharged out of the hydraulic drive unit, the first diaphragm is stopped during the downward movement thereof. In this case, an amount of air to be sucked from the toilet drain passage for the next toilet flushing is decreased, whereupon there is a possibility that the toilet flushing cannot be performed suitably without initiation of a siphon action.

Furthermore, an amount of tap water supplied per time or the like changes with a change in an installation location such as an area, building, floor, etc. where the toilet body is installed, and status of use such as a time zone when the toilet body is used, and the like. This then changes a speed at which the second diaphragm is upwardly moved and an amount of upward movement of the second diaphragm, resulting in changes in a speed at which the bar-like member pushes the first diaphragm upward, and the like. This results in variations in status of suction of air in the toilet drain passage by the second chamber, whereupon the toilet flushing may not be carried out successfully.

More specifically, when the speed at which the first diaphragm is pushed upward is excessively high, air is sucked by the second chamber from the toilet drain passage under the condition that flush water is not sufficiently supplied into the toilet body. In this case, the siphon action may not be initiated since a sufficient amount of flush water cannot be caused to flow into the toilet drain passage. Furthermore, when the speed at which the first diaphragm is pushed upward is too low or when an amount of movement of the first diaphragm is too small, an air suction force of the second diaphragm from the toilet drain passage is reduced. In this case, too, the siphon action may not be initiated since a sufficient amount of flush water cannot be caused to flow into the toilet drain passage. When no siphon action is initiated, waste is not discharged outside the toilet body, whereupon the toilet flushing may not be carried out successfully.

SUMMARY

The present invention was made in view of the foregoing circumstances of the conventional technique, and the subject matter to be overcome is to provide an air suction device for toilet drain passage, which can normally initiate a siphon action and can carry out toilet flushing successfully irrespective the installation location of the toilet body or the condition of use.

The present invention provides an air suction device for a toilet drain passage, which sucks air from the toilet drain passage connected to a downstream side of a water sealing section of a toilet body. The air suction device comprises a suction tank provided with a first diaphragm which is placed in a housing so as to be vertically movable at an installed position, the suction tank being partitioned by the first diaphragm into an upper first chamber and a lower second chamber which communicates with the toilet drain passage, and an electromagnetic drive device which moves the first diaphragm upward. In the air suction device, the electromagnetic drive device has a cylindrical case body installed away from the suction tank and extending vertically at an installed position, a moving member which is housed in the case body so as to be vertically movable, and a moving device provided on a lower end of the case body. The moving device has a casing and an actuator which is assembled in the casing to move the moving member. The case body is provided with a first airtight chamber surrounded by the moving member and the moving device in the case body, the first airtight chamber having a cubic capacity that is changed by movement of the moving member and communicating via a communication conduit with the first chamber. The first airtight chamber sucks air in the first chamber to move the first diaphragm upward.

In the air suction device for the toilet drain passage, the first diaphragm can be moved vertically at a predetermined speed by a predetermined amount with a predetermined timing by the electromagnetic drive device when the toilet flushing is carried out. Accordingly, the state of air suction from the toilet drain passage is not varied, and flush water can be caused to flush into the toilet drain passage swiftly. Accordingly, a strong siphon action can reliably be initiated, and waste can be discharged out of the toilet body.

Accordingly, the siphon action can normally be initiated irrespective of the installation location or the condition of use of the toilet body, whereupon the toilet flushing can be carried out successfully.

In the above-described air suction device, upon start of toilet flushing, the moving member is moved upward by the actuator such that the first airtight chamber is enlarged. Consequently, since air in the first chamber is sucked, the first diaphragm can be ascended. Thus, the first diaphragm can be moved vertically at a predetermined speed by a predetermined amount with a predetermined timing by driving the actuator. As a result, the state of air suction from the toilet drain passage is not varied, and flush water can be caused to flush into the toilet drain passage swiftly. Accordingly, a strong siphon action can reliably be initiated such that waste can be discharged out of the toilet body.

Furthermore, since the electromagnetic drive device is disposed away from the suction tank, the suction tank needs only to have a cubic capacity corresponding to an amount of air sucked from the toilet drain passage, whereupon an increase in the size thereof can be avoided. Furthermore, since the electromagnetic drive device can be disposed in vacant space defined in the rear of a toilet bowl of the toilet body, an effective use of space can be facilitated. And yet, since the electromagnetic drive device is not located above the suction tank, a low silhouette Western style flushing toilet can be realized, whereupon the freedom in the design of the Western style flushing toilet can be improved.

The moving member may have a second diaphragm including a cylindrical portion extending vertically along an inner circumferential surface of the case body, a flange extending outward from one of two ends of the cylindrical portion and fixed to the inner circumferential surface of the case body and a central part extending inward from the other end of the cylindrical portion, and a guide mounted on the central part of the second diaphragm to guide the central part so that the central part is moved vertically while being maintained in a horizontal state.

In this case, the electromagnetic drive device can successfully suck air in the first chamber of the suction tank since the moving member is smoothly moved in the case body. Accordingly, the suction tank can stably suck air from the toilet drain passage and the siphon action can stably be initiated. Furthermore, the flange of the second diaphragm is fixed to the inner circumferential surface of the case body, and the second diaphragm is not slid on the inner circumferential surface of the case body or the like when the moving member is moved. As a result, the second diaphragm is hard to wear such that the airtightness of the first airtight chamber can be maintained for a long period of time. Consequently, the electromagnetic drive device can exhibit high durability. And yet, the maintenance such as component replacement of the electromagnetic drive device can be saved.

The case body may have a lower end opening through which an upper part of the moving device is inserted. The guide may be formed by an upper wall mounted to a central underside of the second diaphragm, a side wall extending downward from a peripheral edge of the upper wall and then along the inner circumferential surface of the case body, and a flange extending outward from an outer circumferential edge of a lower end of the side wall. The guide can house an upper part of the moving device when having been moved downward.

In this case, the side wall and the outer circumferential edge of the flange of the guide are moved vertically along the inner circumferential surface of the case body. Accordingly, the moving member can smoothly be moved vertically in the case body while the central part of the second diaphragm is maintained in a horizontal state. Furthermore, since the upper part of the moving device can be housed in the vacant space inside the guide, the electromagnetic drive device can be rendered small-sized. Consequently, the electromagnetic drive device can easily be housed in a housing space or the like provided in the rear of the toilet bowl.

The moving member may be connected to a pulling member drawn out of the case body and moving the moving member upward. In this case, the user can manually pull the pulling member upward. Accordingly, since the moving member can be moved upward when the user pulls the pulling member while confirming of increase or decrease in an amount of flush water in the toilet bowl or initiation of siphon action, a strong siphon action can reliably be initiated such that waste can be discharged out of the toilet body.

The pulling member may vertically be inserted through a guide member located higher than the case body thereby to be guided. In this case, since the pulling member is pulled upward through the guide member, the other members incorporated in the toilet body such as the flush water supply device can be prevented from interfering with the pulling member, and the pulling member can easily be pulled upward. Consequently, the moving member can smoothly be moved upward manually.

The casing may be configured as to define a second airtight chamber therein, and the casing is provided with a communication hole which communicates between the first and second airtight chambers, and the air suction device also includes a first on-off valve which communicates between the second airtight chamber and an atmosphere when the actuator is in a standby state and which closes communication between the second airtight chamber and the atmosphere when the actuator is in a drive state.

In this case, when the actuator returns to the standby state, the moving member is descended and accordingly, the first diaphragm is also moved downward. On this occasion, the first on-off valve provided in the second airtight chamber is opened such that the second airtight chamber communicates with the atmosphere. As a result, the first chamber also communicates with the atmosphere through the communication conduit. Accordingly, air is reliably be discharged from the first airtight chamber, and the first chamber is reliably be filled with air. Consequently, the moving member and the first diaphragm are reliably moved downward to the respective descent positions without being stopped during the downward movement.

Furthermore, when the moving member having been moved downward to the descent position is moved upward by the moving device, the actuator is switched from the standby state to the drive state and the first on-off valve is closed. As a result, the communication between the second airtight chamber and the atmosphere is closed. Accordingly, air in the first chamber reliably flows into the first airtight chamber such that the first diaphragm can reliably be moved to the ascent position. Consequently, when the toilet flushing is carried out, air can reliably be sucked from the toilet drain passage and accordingly, the siphon action can reliably be initiated, whereupon the toilet flushing can repeatedly be performed successfully.

The communication conduit may be provided with an aperture which communicates between the communication conduit and an atmosphere. In this case, since the first airtight chamber and the first chamber communicate with the atmosphere through the aperture, the moving member is descended. Accordingly, when the first diaphragm is descended, air is reliably discharged from the first airtight chamber and the first chamber is reliably be filled with air. Consequently, the moving member and the first diaphragm are reliably descended to the respective descent positions without being stopped during the descent.

Furthermore, when the moving member having been moved downward to the descent position is moved upward by the moving device, the moving member is rapidly moved upward such that the first airtight chamber sucks a large amount of air at once. On this occasion, although air also flows through the aperture of the communication conduit into the first airtight chamber, an amount of air flowing into the first airtight chamber is slight. Accordingly, the first airtight chamber reliably sucks air in the first chamber such that the first diaphragm can reliably be ascended to the ascent position. Consequently, when the toilet flushing is carried out, air can reliably be sucked from the toilet drain passage and accordingly, the siphon action can reliably be initiated, whereupon the toilet flushing can repeatedly be performed successfully.

The communication conduit may be provided with a second on-off valve which normally communicates between the communication conduit and an atmosphere and which closes communication between the communication conduit and the atmosphere when pressure in the communication conduit is lower than an atmospheric pressure. In this case, when the moving member is descended and the first diaphragm is accordingly descended, the second on-off valve is open since the pressure in the communication conduit is not reduced lower than the atmospheric pressure. More specifically, the first airtight chamber and the first chamber communicate with the atmosphere through the second on-off valve provided on the communication conduit. Accordingly, air is reliably discharged from the first airtight chamber and the first chamber is reliably be filled with air. Consequently, the moving member and the first diaphragm are reliably descended to the respective descent positions without being stopped during the descent.

Furthermore, when the moving member having been moved downward to the descent position is moved upward by the moving device, the second on-off valve is closed since pressure in the communication conduit is lower than the atmospheric pressure. More specifically, the communication between the communication conduit and the atmosphere is closed. Accordingly, air in the first chamber reliably flows into the first airtight chamber such that the first diaphragm can reliably be ascended to the ascent position. Consequently, when the toilet flushing is carried out, air can reliably be sucked from the toilet drain passage and accordingly, the siphon action can reliably be initiated, whereupon the toilet flushing can repeatedly be performed successfully.

The electromagnetic drive device may be connected to a central part of the first diaphragm and has a connecting member extending vertically and an electric motor fixed to the housing of the suction tank and raises the connecting member vertically. In this case, the size of the air suction device can be reduced since the structure of the air suction device is simplified. Furthermore, an accurate moving speed and an accurate amount of movement of the first diaphragm can be realized since the first diaphragm can be moved upward directly by the connecting member. More specifically, an accurate air suction speed and an accurate amount of air sucked can be realized when a speed of air suction from the toilet drain passage and an amount of air sucked from the toilet drain passage are set according to a type of the toilet body such as the shape of the toilet body, the capacity of the toilet drain passage or the like. Accordingly, the air suction device can readily be applied to a plurality of types of Western style flushing toilets.

DETAILED DESCRIPTION

Figure 1:
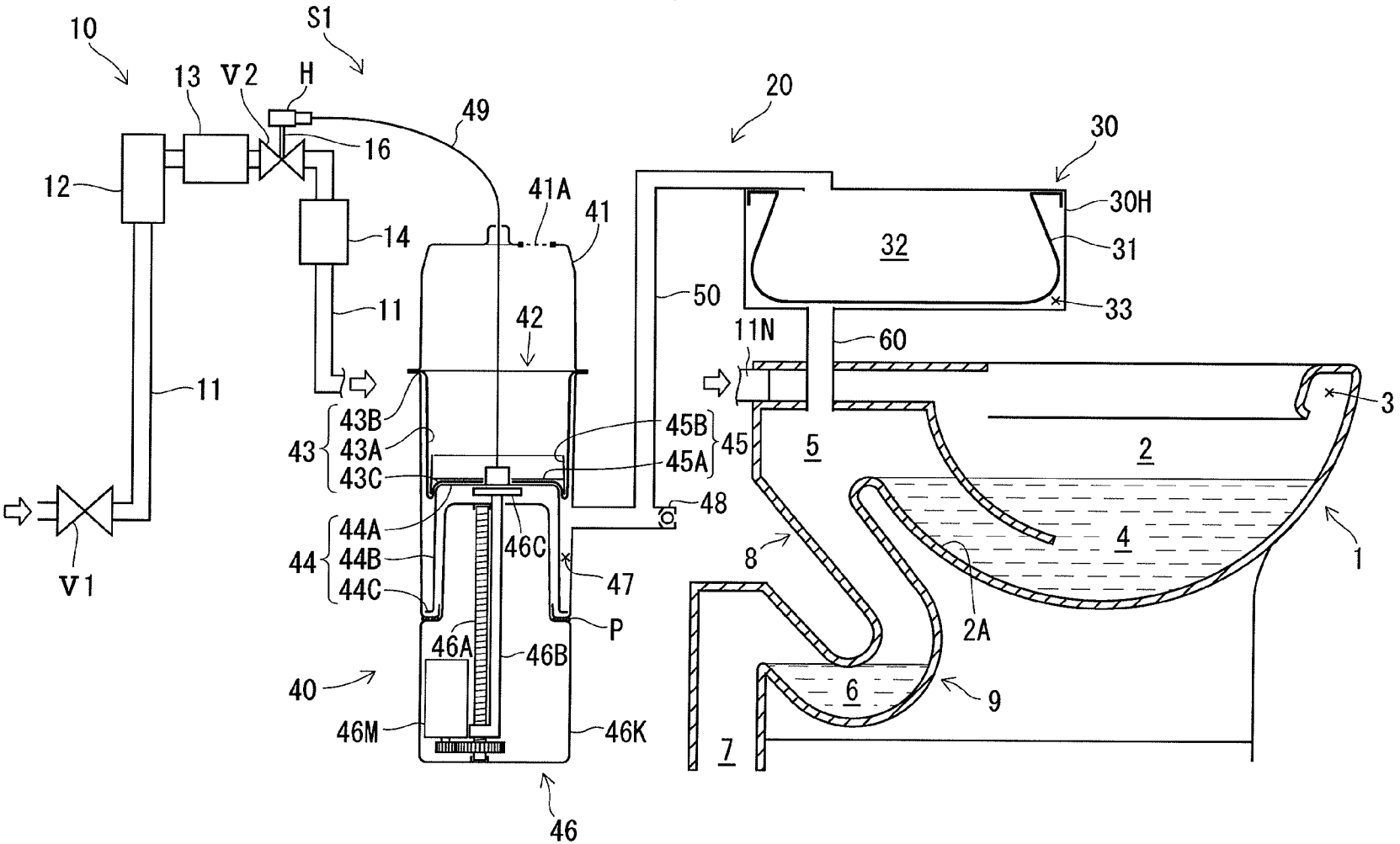
FIG. 1 is a view showing a frame format of a Western style flushing toilet of embodiment 1.

Embodiments 1 to 4 of a Western style flushing toilet will be described with reference to the drawings. The air suction device for the toilet drain passage in accordance with the present invention is applied to the flushing toilet.

Embodiment 1

The Western style flushing toilet of embodiment 1 comprises a toilet body 1 and a toilet flushing device S1 as shown in FIGS. 1 to 7. A toilet seat and a toilet lid are eliminated in the drawings.

Figure 4:
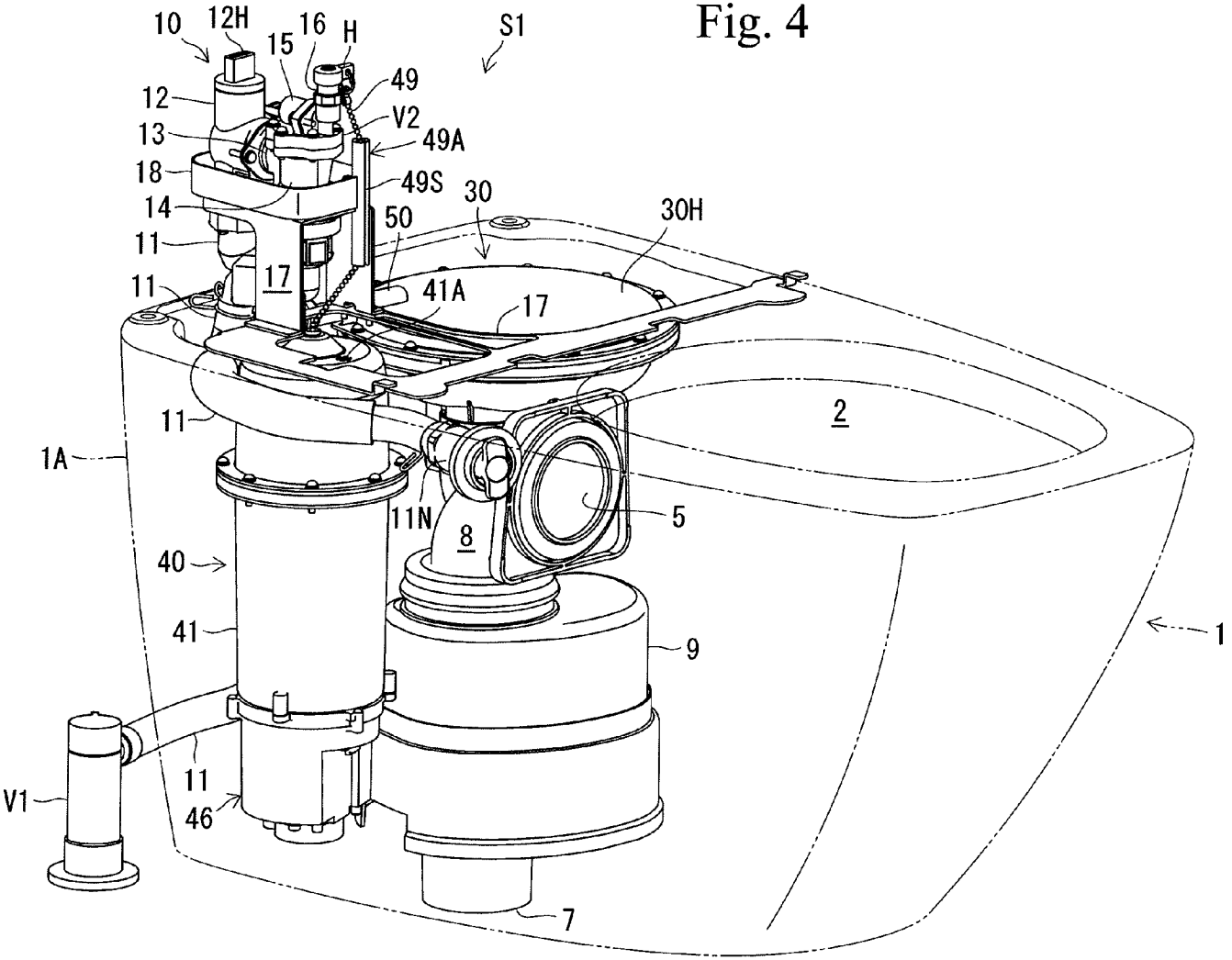
FIG. 4 is a perspective view of the Western style flushing toilet of embodiment 1.

The toilet body 1 has a rim 3 formed along an upper inner periphery of a toilet bowl 2. The toilet body 1 is formed with an uprise flow path 2A extending upward from a lower end of the toilet bowl 2 and with a water sealing section 4 located in a lower interior of the toilet bowl 2. The uprise flow path 2A of the toilet body 1 has a downstream end to which a downstream drain conduit 8 defining a toilet drain passage 5 therein is connected, as shown in FIG. 4. The downstream drain conduit 8 has a downstream end to which is connected a drain connecting member 9 defining a dwell section 6 therein and having a drain outlet 7. The drain outlet 7 communicates with a drain conduit drawn to a floor face of a toilet room (not shown) in which the toilet body 1 is installed.

The toilet flushing device S1 includes a flush water supply device 10 and an air suction device 20 sucking air from the toilet drain passage 5 as shown in FIG. 1.

The flush water supply device 10 has a water conduit 11. The water conduit 11 is provided with a valve unit including, in order from the upstream side, a strainer device 12 incorporating a water stop valve and a strainer, a constant flow valve 13, an on-off valve V2 and a vacuum breaker 14. The water conduit 11 connected to the upstream and downstream sides of the valve unit comprises a flexible hose with a predetermined pressure resistance as shown in FIG. 4. The flexible hose connected to the upstream side of the valve unit is drawn out of the rear of the toilet body 1 and connected to a stop cock V1 provided in the floor face of the toilet room. The stop cock V1 is connected to the water pipe. On the other hand, a flexible hose connected to the downstream side of the valve unit has a distal end on which a nozzle 11N is mounted and communicates with the rim of the toilet body 1.

The strainer 12 has an upper end on which a cover member 12H is mounted. When the cover member 12 is detached, the strainer housed in the strainer device 12 can be taken out. In the on-off valve V2, pilot valves are opened and closed so that a main valve or diaphragm valve is opened and closed. The on-off valve V2 is provided with two pilot valves. One of the pilot valves is opened and closed by an electromagnetic actuator 15, while the other pilot valve is opened and closed by manually operating a drive shaft 16. A flushing handle H is detachably attached to a distal end of the drive shaft 16.

The air suction device 20 includes a suction tank 30 provided with a first diaphragm 31 which is placed in a housing 30H so as to be vertically movable at an installed position, and an electromagnetic drive device 40 moving the first diaphragm 31 upward, as shown in FIG. 1. The suction tank 30 and the electromagnetic drive device 40 are surrounded by the side wall 1A of the toilet body 1 and installed in an accommodation space defined in the rear of the toilet bowl 2 so as to be spaced away from each other, as shown in FIG. 4. Accordingly, the suction tank 30 necessitates only a capacity corresponding to an amount of air sucked from the toilet drain passage 5, thereby avoiding an increase in size. Furthermore, since the suction tank 30 is disposed in the accommodation space defined in the rear of the toilet bowl 2, an effective use of space can be facilitated. And yet, since the electromagnetic drive device 40 is not located above the suction tank 30, a low silhouette Western style flushing toilet can be realized, whereupon the freedom in the design of the Western style flushing toilet can be improved.

An interior of the suction tank 30 is partitioned into an upper first chamber 32 and a lower second chamber 33 by a first diaphragm 31 as shown in FIG. 1. Each of the first and second chambers 32 and 33 has predetermined airtightness. The first chamber 32 communicates via a communication conduit 50 with a first airtight chamber 47 of the electromagnetic drive device 40 as will be described later. Furthermore, the second chamber 33 communicates via a suction conduit 60 with the toilet drain passage 5.

The electromagnetic drive device 40 includes a vertically extending cylindrical case body 41, a moving member 42 which is housed in the case body 41 so as to be vertically movable, and a moving device 46 provided on a lower end of the case body 41. A first airtight chamber 47 is defined by the moving member 42 and the moving device 46 in the case body 41 and changes a cubic capacity thereof with movement of the moving member 42.

The case body 41 has an upper end face formed with an opening 41A through which air is passable. A filter is attached to the opening 41A so that trash or the like can be prevented from entering into the case body 41. Furthermore, the case body 41 has an open lower end. An upper part of the moving device 46 is inserted into the lower end opening of the case body 41 thereby to be accommodated in the case body 41. A packing P is interposed between a lower circumferential edge of the case body 41 and a stepped portion provided in the middle of a side wall of the moving device 46, thereby retaining airtightness of the first airtight chamber 47.

The communication conduit 50 is connected to the side wall of the case body 41. The first airtight chamber 47 communicates via the communication conduit 50 with the first chamber 32 of the suction tank 30. An on-off valve 48 is provided on the middle of the communication conduit 50. The on-off valve 48 is normally open to the atmosphere and is closed when the moving member 42 of the electromagnetic drive device 40 is moved.

The moving member 42 includes a second diaphragm 43 having a predetermined elasticity, a first guide 44 mounted on the underside of a central part 43C of the second diaphragm 43, and a second guide 45 mounted on the upper surface of the central part 43C of the second diaphragm 43. The second diaphragm 43 includes a cylindrical portion 43A extending vertically along the inner circumferential surface of the case body 41, a flange 43B extending outward from one end of the cylindrical portion 43A and held by the inner circumferential surface of the case body 41 thereby to be fixed, and a central part 43C extending inward from the other end of the cylindrical portion 43A.

The first guide 44 is formed into a downwardly directed cup shape and includes an upper wall 44A mounted on the underside of the central part 43C of the second diaphragm 43, a side wall 44B extending downward from the circumferential edge of the upper wall 44A along the inner circumferential surface of the case body 41 and a flange 44C extending outward from a lower outer circumferential edge of the side wall 44B. The upper wall 44A is formed into a similar shape to the central part 43C of the second diaphragm 43 and is smaller than the central part 43C of the second diaphragm 43. The first guide 44 is located in the lower interior of the case body 41 when located at a descent position.

The second guide 45 includes a bottom wall 45A mounted on an upper surface of the central part 43C of the second diaphragm and a side wall 45B extending vertically from the circumferential edge of the bottom wall 45A along the inner circumferential surface of the case body 41. The bottom wall 45A is formed into a similar shape to the upper wall 44A of the first guide 44 and is larger than the upper wall 44A of the first guide 44.

The moving member 42 can smoothly be moved upward and downward by the first and second guides 44 and 45 in the case body 41. More specifically, when the moving member 42 is moved upward or downward, the moving member 42 is moved along the inner circumferential surface of the case body 41 by the side wall 44B of the first guide 44, the flange 44C and the side wall 45B of the second guide 45. Accordingly, the central part 43C of the second diaphragm 43 is vertically movable while retaining a horizontal state.

Figure 2:
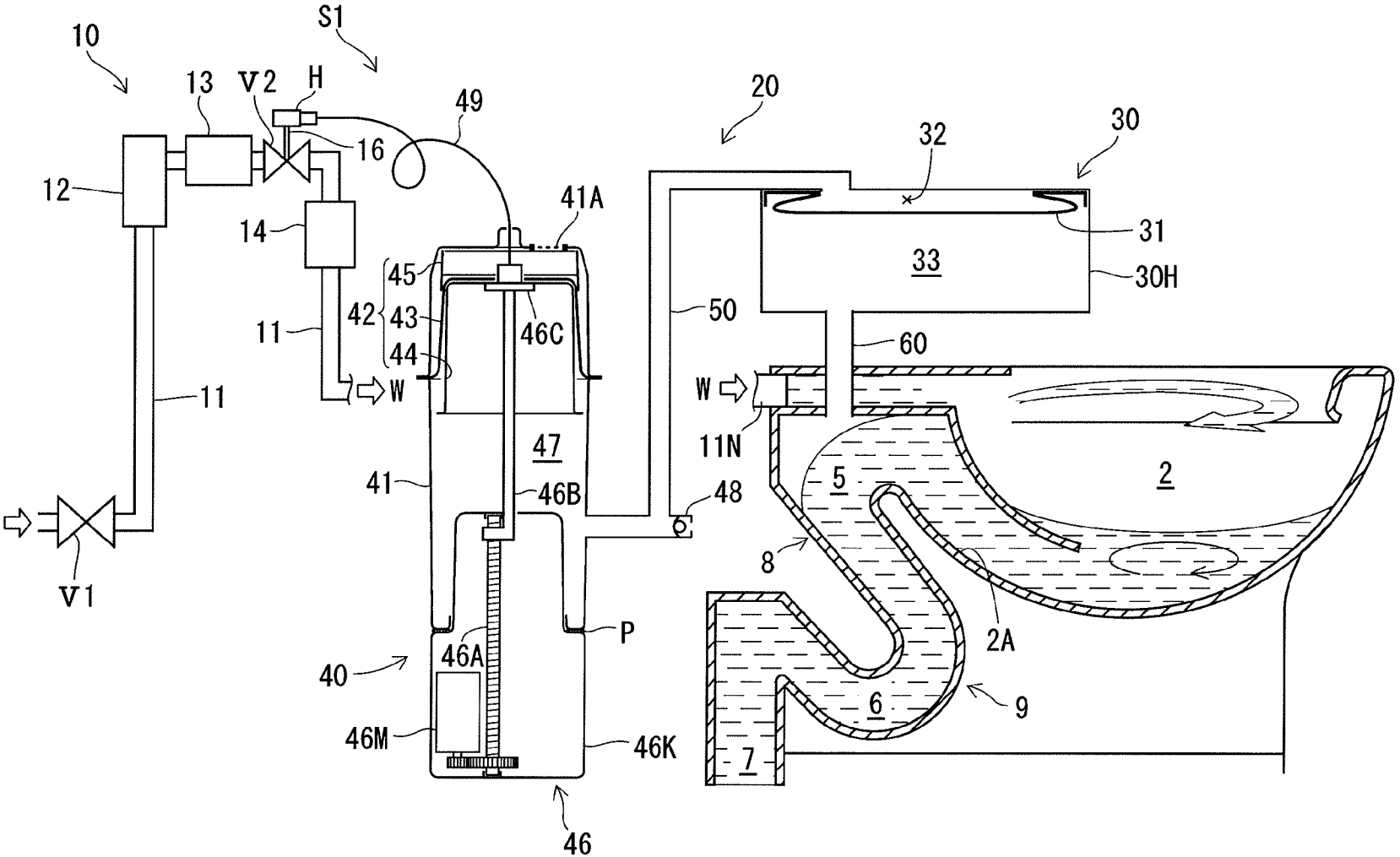
FIG. 2 is a view showing a frame format of the Western style flushing toilet of embodiment 1, showing a flushing state of the toilet.

Furthermore, when the moving member 42 is moved upward, the second diaphragm 43 is deformed so as to cover the outer circumferential surface of the side wall 44B of the first guide 44, as shown in FIG. 2. On the other hand, when the moving member 42 is moved downward, the second diaphragm 43 is deformed while being pressed by the lower circumferential edge of the side wall 45B of the second guide 45, as shown in FIG. 1. Accordingly, since the second diaphragm 43 is not slid on the inner circumferential surface of the case body 41, the second diaphragm 43 is hard to wear such that the airtightness of the first airtight chamber 47 is maintained for a long period of time. As a result, the drive device 40 can perform an excellent durability. And yet, the maintenance of the drive device 40 such as replacement of the second diaphragm 43 can be saved.

Furthermore, the upper portion of the moving device 46 is accommodated inside the first guide 44 when the moving member 42 has been moved downward, as shown in FIG. 1. Accordingly, the electromagnetic drive device 40 can be rendered small-sized. Consequently, the electromagnetic drive device 40 can easily be housed in a housing space or the like provided in the rear of the toilet bowl 2.

The moving device 46 has a casing 46K and an actuator which is assembled to the casing 46K and moves the moving member 42. The actuator has an electric motor 46M, a screw shaft 46A and a bar-like member 46B. The screw shaft 46A is rotated by the electric motor 46M. The bar-like member 46B has a lower end formed with a nut fitted with the screw shaft 46A. The bar-like member 46B has an upper end which protrudes above the moving device 46 and to which a disc-shaped upwardly pressing plate 46C is fixed. The upwardly pressing plate 46C has an upper surface that is not fixed to the moving member 42. Accordingly, when the upwardly pressing plate 46C is moved upward, the moving member 42 is pushed upward, whereas the moving member 42 moves downward by the self weight when the upwardly pressing plate 46C is moved downward.

The moving member 42 is connected to a lower end of a ball chain 49 (a pulling member) drawn out of the upper end surface of the case body 41. The ball chain 49 has an upper end to which a flushing handle H is connected to prevent the upper end of the ball chain 49 from entering into the case body 41.

Figure 5:
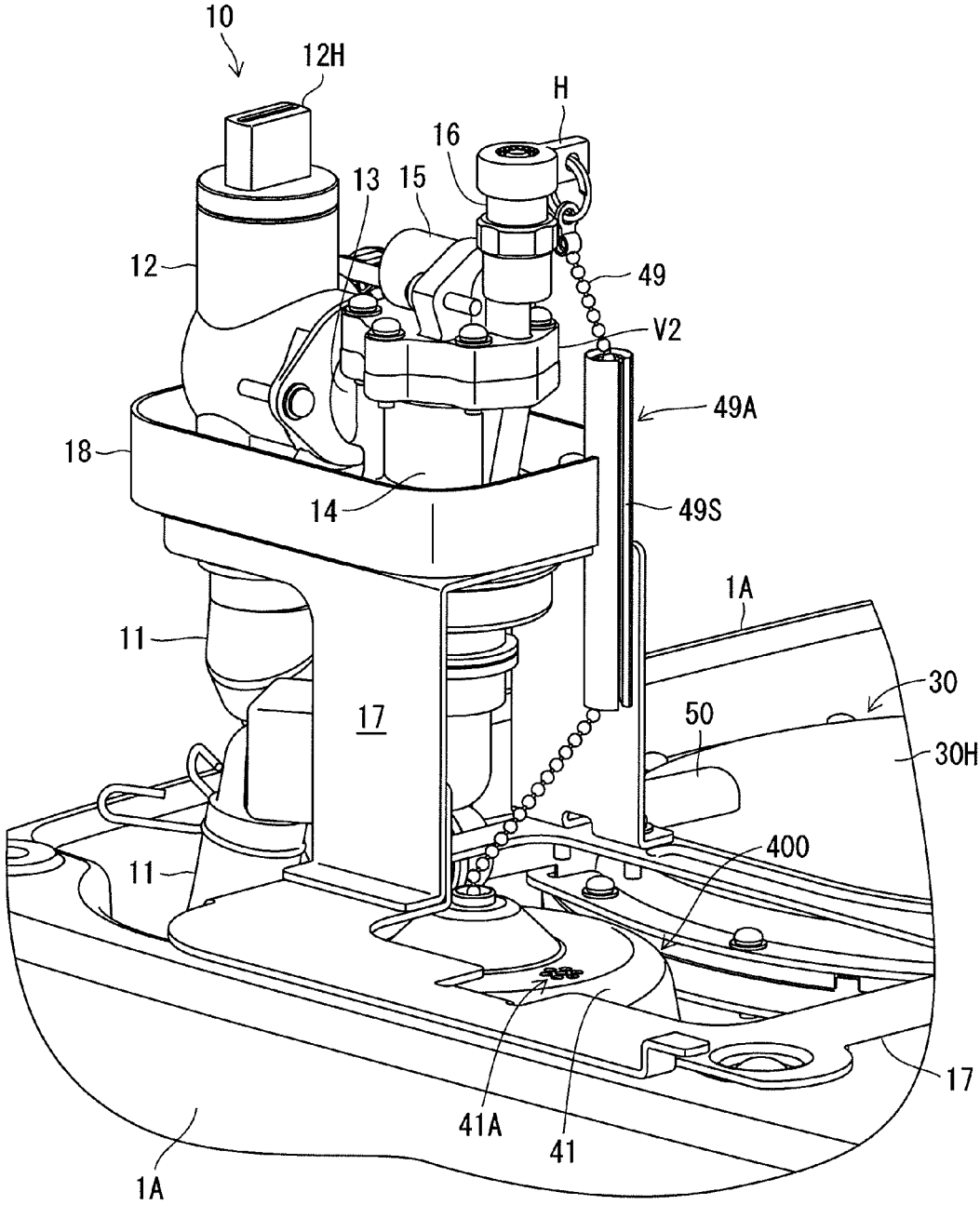
FIG. 5 is a partially enlarged view of the Western style flushing toilet of embodiment 1.

The ball chain 49 is vertically inserted through a guide member 49A disposed higher than the case body 41 of the drive device 40 as shown in FIGS. 4 and 5. The guide member 49A has a slit 49S formed in a side thereof so that the slit 49S extends from an upper end to a lower end thereof and comprises a vertically extending cylindrical member. The guide member 49A is formed integrally on a water-receiving member 18 which receives dew condensation water produced on an outer surface of the valve unit and water leaking from the vacuum breaker 14. The water-receiving member 18 is fixed to a frame 17 further fixed to the rear upper surface of the toilet body 1 and is located higher than the rear upper surface of the toilet body 1. Accordingly, the ball chain 49 inserted through the guide member 49A can easily be pulled upward without interference with the flush water supply device 10 and the like. As a result, the moving member 42 in the drive device 40 can manually be moved upward smoothly.

A wire connecting the balls of the ball chain 49 is insertable through the slit 49S of the guide member 49A. Accordingly, when the ball chain 49 is pulled upward while the wire is inserted through the slit 49S from the lower end of the slit 49S, the ball chain 49 can be inserted through the guide member 49A. Each ball of the ball chain 49 is larger than the width of the slit 49S, and the flushing handle H is connected to the upper end of the ball chain 49. As a result, since the ball chain 49 is prevented from being detached from the guide member 49A, the ball chain 49 is caught on the upper end of the guide member 49A even when the user releases his/her hand from the ball chain 49. Thus, the flushing handle Hand the ball chain 49 are prevented from falling into the accommodation space defined in the rear of the toilet bowl 2.

Figure 6:
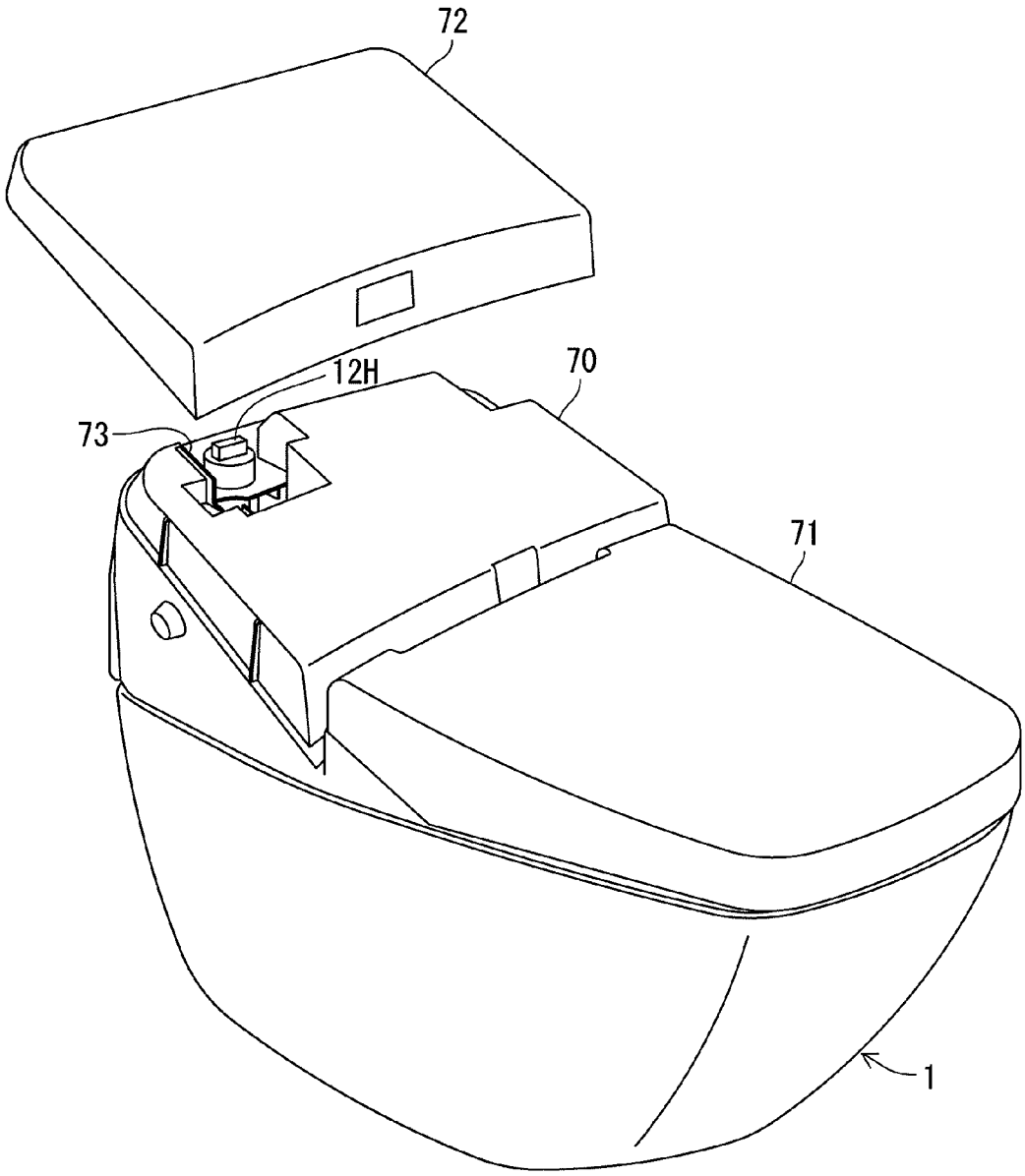
FIG. 6 is an outline view of the Western style flushing toilet of embodiment 1.
Figure 7:
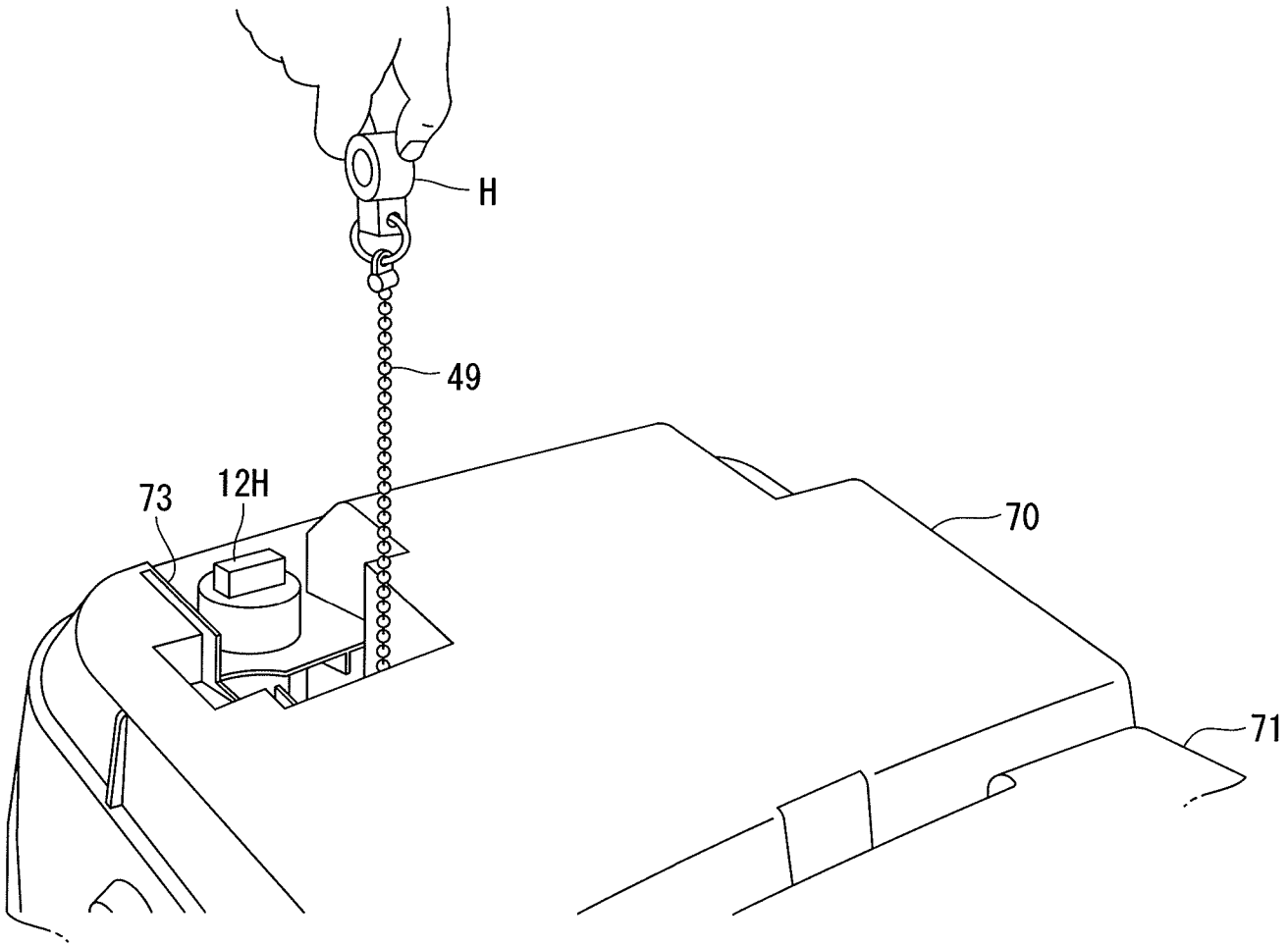
FIG. 7 is a partially enlarged outline view of the Western style flushing toilet of embodiment 1.

A case 70 is mounted on the rear upper face of the Western style flushing toilet body 1 to support a toilet cover 71 and a toilet seat so that the toilet cover 71 and the toilet seat are pivotable, as shown in FIG. 6. A cover 72 covering an upper face of the case 70 is detachably attached to the upper face of the case 70. A part of the toilet flushing device S1 is enclosed in the case 70. The upper face of the case 70 has an opening 73 through which a part of the flush water supply device 10 is exposed. The cover member 12H of the strainer device 12 can be detached through the opening 73 so that the strainer is taken out through the opening 73. Furthermore, as shown in FIG. 7, the user can detach the flushing handle H from the distal end of the drive shaft 16 of the on-off valve V2 and manually pull the ball chain 49. In this case, since the upper end of the ball chain 49 is disposed at a specified position (the distal end of the drive shaft 16) in the toilet flushing device S1, the user can easily grasp the ball chain 49 serving as the pulling member.

Toilet flushing by the Western style flushing toilet of embodiment 1 will be carried out as follows. When the user operates a toilet flush switch (not shown) of the Western style flushing toilet, the on-off valve V2 of the flush water supply device 10 is firstly opened by electromagnetic drive. As a result, flush water is supplied from the conduit 11 into the rim 3. The supplied flush water falls down along an inner surface of the toilet bowl 2 while whirling, whereupon a swirl flow is formed in the toilet bowl 2. Waste is gathered to the central area in the toilet bowl 2 by the swirl flow, and toilet paper is softened thereby to adapt to the flush water. Accordingly, waste and toilet paper are discharged out of the toilet body 1 successfully by a siphon action which will be initiated thereafter.

The flush water is supplied into the toilet bowl 2, and the electromagnetic drive device 40 is driven in synchronization with reach of a sufficient high water level in the toilet bowl 2. More specifically, as shown in FIG. 2, the electric motor 46M of the moving device 46 is driven so that the upwardly pressing plate 46C of the bar-like member 46B is moved upward at a predetermined speed to a predetermined level. As a result, the moving member 42 is pushed upward to a predetermined level, and the cubic capacity of the first airtight chamber 47 is increased at a predetermined speed into a predetermined amount. On this occasion, the on-off valve 48 provided on the communication conduit 50 is closed so that air in the first chamber 32 of the suction tank 30 flows through the communication conduit 50 into the first airtight chamber 47.

The first diaphragm 31 is moved upward when air in the first chamber 32 flows into the first airtight chamber 47. As a result, air is sucked from the toilet drain passage 5 into the second chamber 33. On this occasion, the air can reliably be sucked from the toilet drain passage 5 since the flush water leaked from the uprise flow path 2A flows into the dwell section 6 such that the toilet drain passage 5 is disconnected from the drain outlet 7 side. Consequently, the flush water swiftly flushes from the water sealing section 4 into the toilet drain passage 5 such that a strong siphon action is initiated, whereby waste or the like is reliably be discharged out of the toilet body 1.

After a set time has elapsed from the initiation of siphon action, the electric motor 46M is reverse-rotated so that the upwardly pressing plate 46C of the bar-like member 46B is moved downward. Then the moving member 42 moves downward by the self weight. As a result, since air in the first airtight chamber 47 flows through the communication conduit 50 into the first chamber 32 of the suction tank 30, the first diaphragm 31 is descended. Subsequently, the on-off valve 48 provided on the communication conduit 50 is opened to the atmosphere such that the interiors of the first airtight chamber 47 and the first chamber 32 are at the atmospheric pressure. Accordingly, the moving member 42 and the first diaphragm 31 are reliably descended to the respective lowermost points without being stopped in the middle of descent. Thus, in preparation for the next toilet flushing, the moving member 42 and the first diaphragm 31 are located at the respective lowermost positions where air can sufficiently be sucked from the toilet drain passage 5. Consequently, the toilet flushing can be repeatedly carried out successfully.

Upon descent of the first diaphragm 31, air is discharged from the second chamber 33 into the toilet drain passage 5 such that the flush water in the toilet drain passage 5 is caused to flow into the water sealing section 4 side and the dwell section 6 side. Accordingly, the flow of flush water in the toilet drain passage 5 is divided, whereby the siphon action is ended. Thereafter, flush water is supplied from the flush water supply device 10 into the toilet bowl 2 so that water sealing with a predetermined water level is provided, whereby the toilet flushing is completed.

According to the toilet flushing device S1 of embodiment 1, the toilet flushing can normally be carried out successfully when the user just operates the toilet flush switch. Furthermore, in execution of the toilet flushing, the upwardly pressing plate 46C can be moved upward by the predetermined amount at the predetermined speed with the predetermined timing by the electric motor 46M. Accordingly, the first diaphragm 31 can be moved upward at the predetermined speed by the predetermined amount with the predetermined timing. As a result, the state of air suction from the toilet drain passage 5 is not varied, and flush water can be caused to flush from the water sealing section 4 into the toilet drain passage 5 swiftly. Accordingly, a strong siphon action can reliably be initiated, and waste can be discharged out of the toilet body 1. Furthermore, when air in the toilet drain passage 5 is sucked by the air suction device 20, the siphon action can be initiated early. Thus, since waste is discharged out of the toilet body 1 with a smaller amount of flush water, the saving of flush water can be facilitated.

Figure 3:
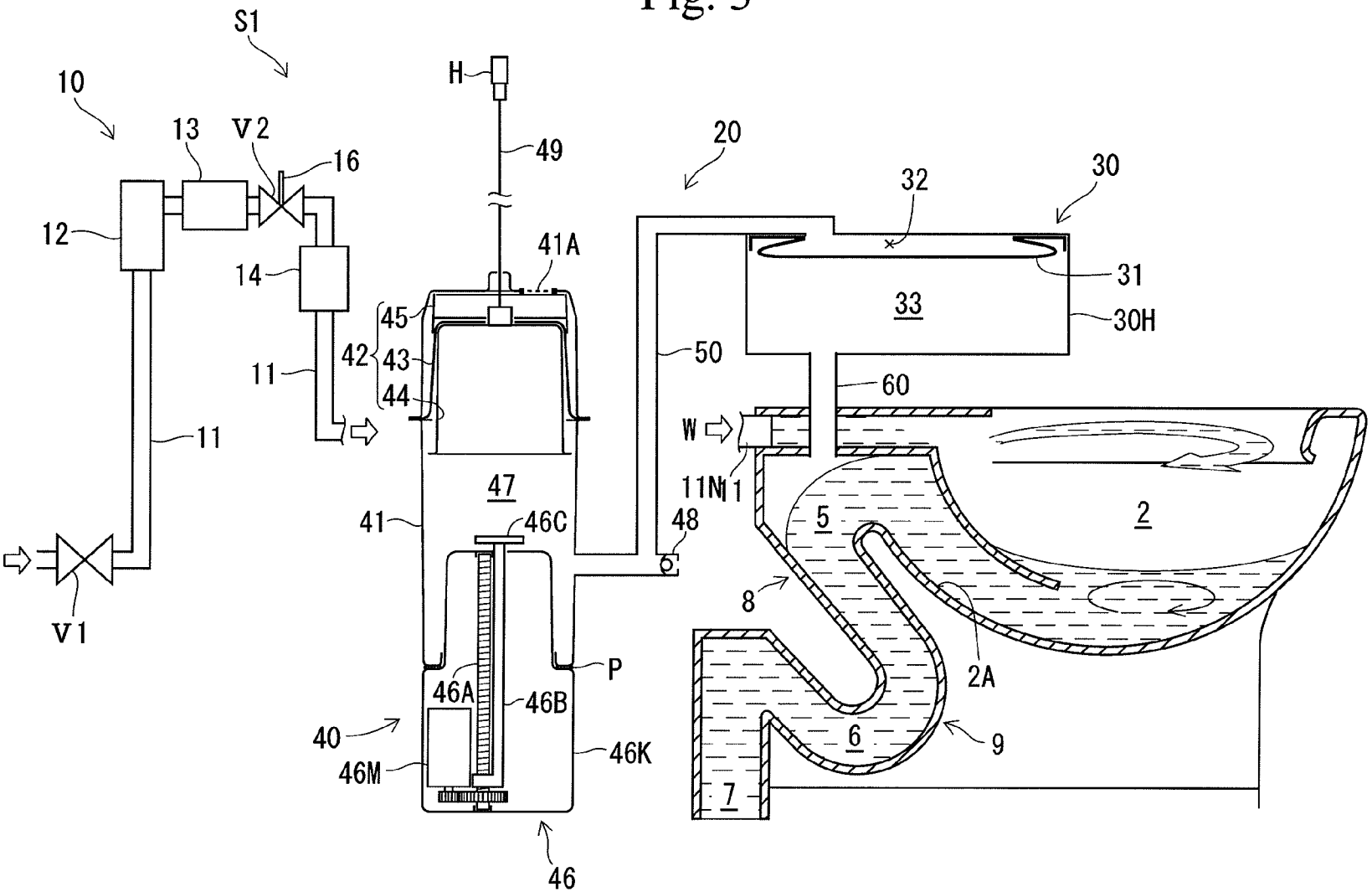
FIG. 3 is a view showing a frame format of the Western style flushing toilet of embodiment 1, showing a flushing state of the toilet during electric power failure.

The user can manually carry out toilet flushing in the case where the electric motor 46M cannot be driven due to electric power failure or the like. More specifically, the user firstly detaches the cover 72 from the upper face of the case 70 to manually operate the flushing handle H mounted on the drive shaft of the on-off valve V2 through the opening 73, thereby opening the on-off valve V2. As a result, flush water is supplied into the toilet bowl 2. Upon elapse of a predetermined time or longer, the user confirms that the water level in the toilet bowl 2 is sufficiently high. Thereafter, the user detaches the flushing handle H from the drive shaft of the on-off valve V2, manually pulling the ball chain 49 at a stroke. On this occasion, since the ball chain 49 is inserted through the guide member 49A, the ball chain 49 can easily be pulled upward without interference with the flush water supply device 10 or the like. The moving member 42 is then moved upward to a predetermined level such that the cubic capacity of the first airtight chamber 47 is increased as shown in FIG. 3. Air in the first chamber 32 of the suction tank 30 flows through the communication conduit 50 into the first airtight chamber 47, and the first diaphragm 31 is moved upward. As a result, air is sucked from the toilet drain passage 5 into the second chamber 33 so that a strong siphon action is initiated. Consequently, waste or the like can reliably be discharged out of the toilet body 1.

After the ball chain 49 has been maintained in the pulled state for a predetermined time after initiation of siphon action, the user releases the pulled ball chain 49 and re-attaches the flushing handle H to the drive shaft of the on-off valve V2. As a result, since the moving member 42 moves downward by self-weight and the first diaphragm 31 also descends, air is discharged into the toilet drain passage 5, whereby the siphon action is ended. Thereafter, flush water is supplied into the toilet bowl 2 so that water sealing with a predetermined water level is provided. The user manually operates the on-off valve V2 to close the on-off valve V2, whereby the toilet flushing is completed. Thus, even when the electric motor 46M cannot be driven due to electric power failure or the like, the toilet flushing can be carried out successfully. Accordingly, the air suction device 20 of embodiment 1 can normally initiate the siphon action and carry out the toilet flushing successfully irrespective of the installation location of the toilet body 1 or the condition of use.

Embodiment 2

Figure 8:
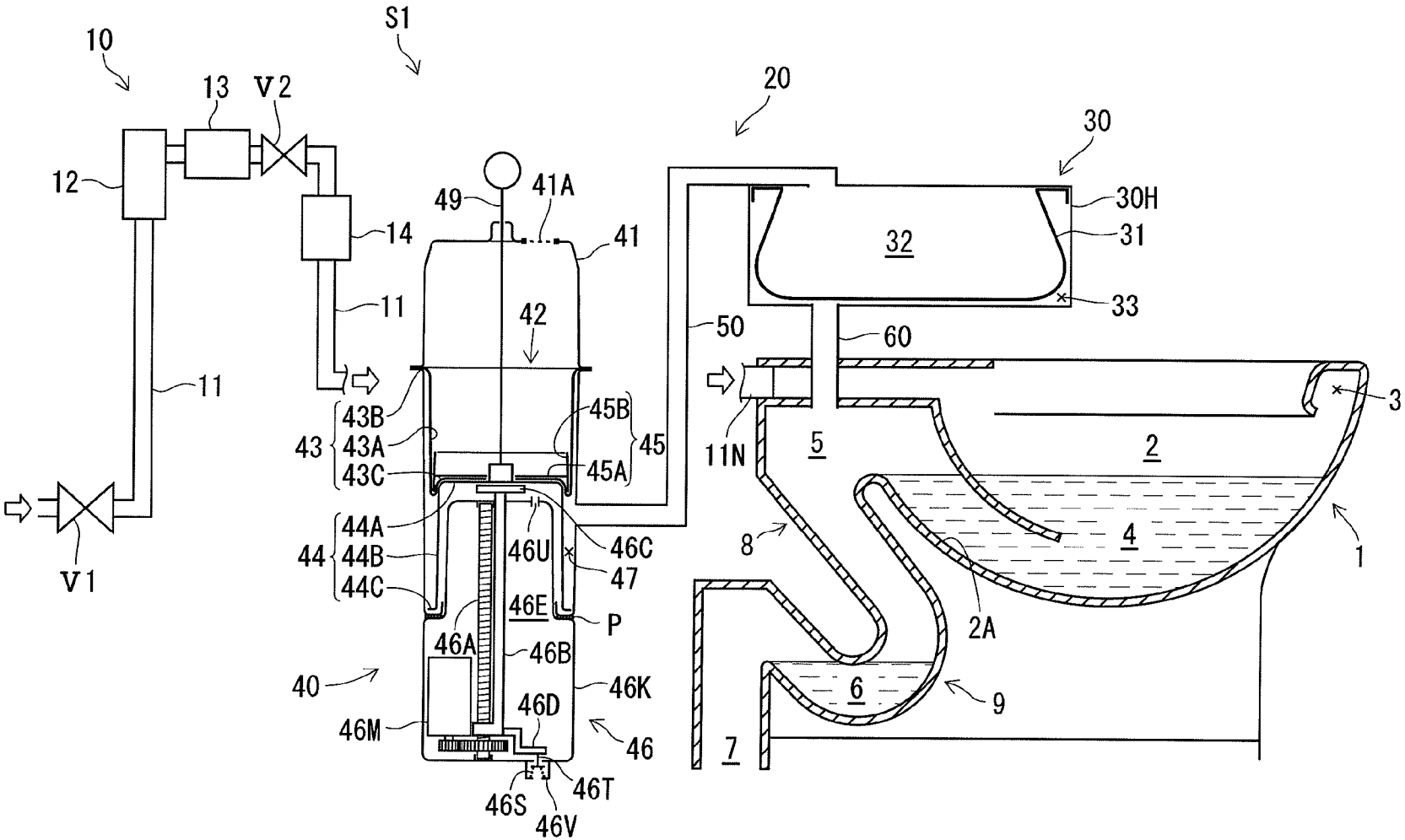
FIG. 8 is a view showing a frame format of a Western style flushing toilet of embodiment 2.
Figure 9:
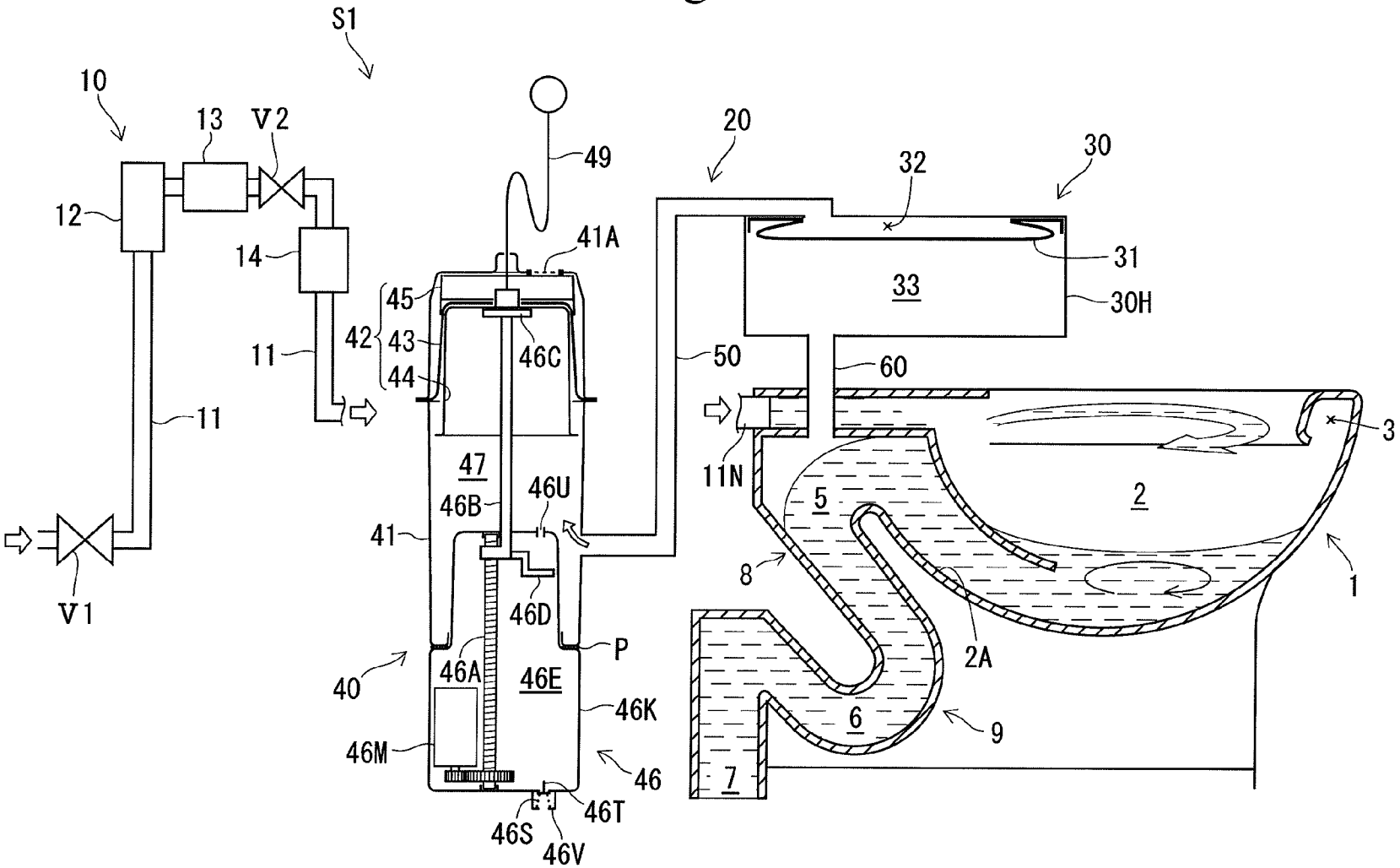
FIG. 9 is a view showing a frame format of the Western style flushing toilet of embodiment 2, showing a flushing state of the toilet.

In the Western style flushing toilet of embodiment 2, as shown in FIGS. 8 and 9, the moving device 46 has the different structure from the above-described embodiment 1 without provision of the on-off valve 48 in the middle of the communication conduit 50 which communicates between the first airtight chamber 47 formed in the case body 41 and the first chamber 32 of the suction tank 30. Since the other structure is the same as of the foregoing embodiment 1, the same reference symbols are affixed to the same structure and the description of structure, operation and effect will be eliminated.

The casing 46K of the moving device 46 has a second airtight chamber 46E defined therein. The casing 46K has an upper surface provided with a communication hole 46U which communicates between the first and second airtight chambers 47 and 46E. The casing 46K has an underside provided with an opening in which the first on-off valve 46V is assembled. The first on-off valve 46V has a valve element 46T which is urged by a spring 46S in such a direction that the on-off valve 46V is closed.

The bar-like member 46B of the actuator has a lower end provided with a downwardly pressing plate 46D extending sideways. When the downwardly pressing plate 46D is located at the descent position, that is, when the actuator is on standby, the downwardly pressing plate 46D presses the valve element 46T of the first on-off valve 46V downward such that the first on-off valve 46V is open. Accordingly, the second airtight chamber 46E communicates with the atmosphere. Furthermore, as shown in FIG. 9, when the downwardly pressing plate 46D is located at the ascent position, that is, when the actuator is in a movement state, the valve element 46T of the first on-off valve 46V is in a closed state by the urging force of the spring 46S. Accordingly, the communication between the second airtight chamber 46E and the atmosphere is closed.

In the electromagnetic drive device 40 of embodiment 2, the electric motor 46M of the moving device 46 is driven so that the upwardly pressing plate 46C is moved upward to move the moving device 42 upward, and at the same time, the downwardly pressing plate 46D is also moved upward. Accordingly, the valve element 46T of the first on-off valve 46V is closed by the urging force of the spring 46S. This closes the communication between the second airtight chamber 46E and the atmosphere. As a result, since the communication between the first airtight chamber 47 and the atmosphere is thus closed, air in the first chamber 32 reliably flows into the first airtight chamber 47 so that the first diaphragm 31 can reliably be moved to the ascent position. Accordingly, air can reliably be sucked from the toilet drain passage 5 into the second chamber 33, whereupon the siphon action is initiated so that waste or the like can be discharged out of the toilet body 1.

Furthermore, after the set time has elapsed from the initiation of siphon action, the electric motor 46M is reverse-rotated so that the upwardly pressing plate 46C of the bar-like member 46B is moved downward and so that the downwardly pressing plate 46D is also moved downward. When returned to the descent position, the downwardly pressing plate 46D presses the valve element 46T of the first on-off valve 46V downward thereby to open the first on-off valve 46V as shown in FIG. 8. Accordingly, the second airtight chamber 46E communicates with the atmosphere, whereupon the air in the first airtight chamber 47 is reliably discharged through the second airtight chamber 46E and the first on-off valve 46V, and air is reliably supplied into the first chamber 32. Consequently, the moving member 42 and the first diaphragm 31 are reliably moved to the descent position without being stopped in the middle of descent. Thus, in preparation for the next toilet flushing, the moving member 42 and the first diaphragm 31 are located at the respective lowermost positions where air can sufficiently be sucked from the toilet drain passage 5. Consequently, the toilet flushing can be repeatedly carried out successfully.

Accordingly, the siphon action can also normally be initiated in the air suction device 20 of embodiment 2 irrespective of the installation location or the condition of use of the toilet body 1, whereupon the toilet flushing can be carried out successfully.

Embodiment 3

Figure 10:
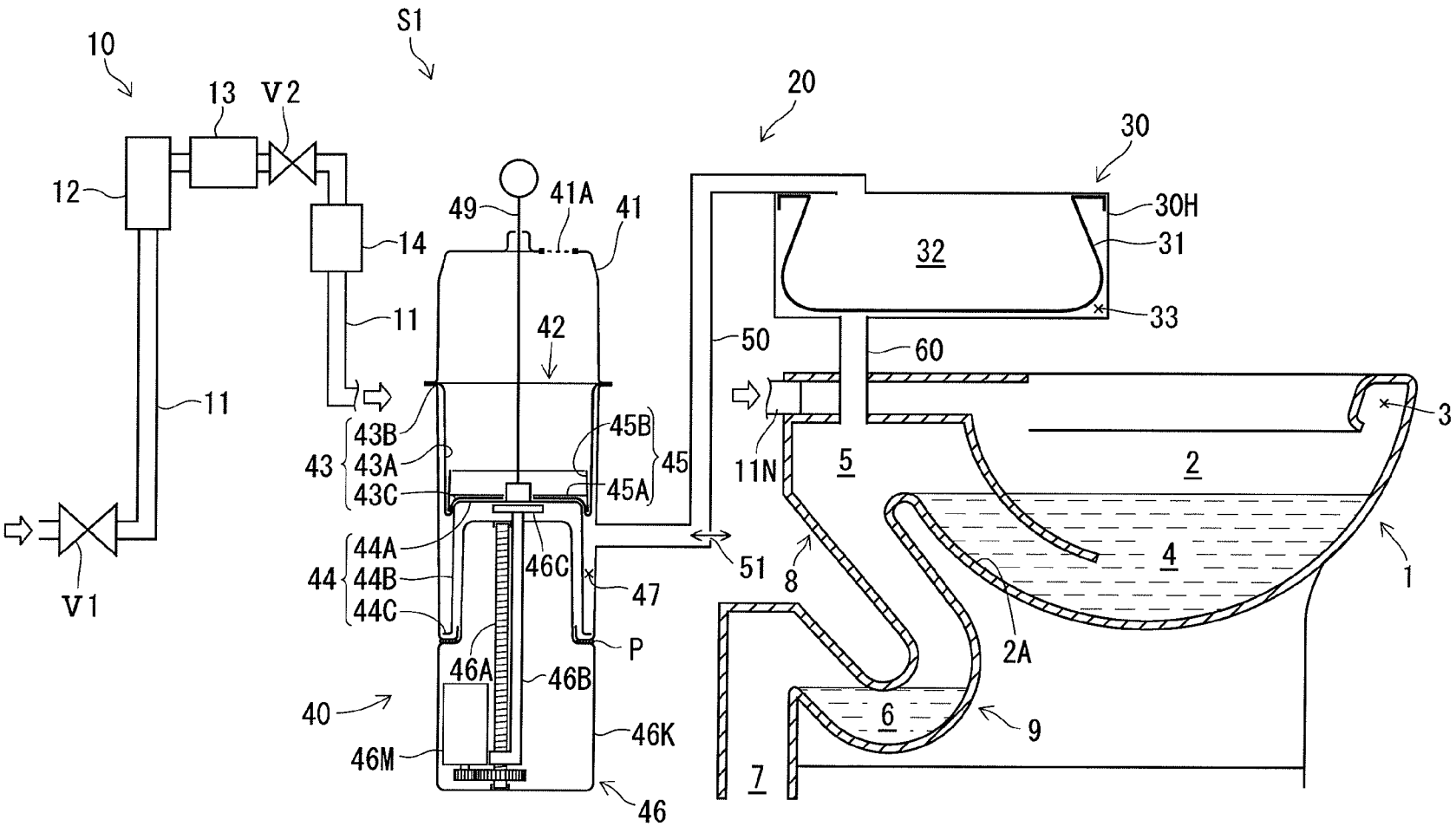
FIG. 10 is a view showing a frame format of a Western style flushing toilet of embodiment 3.
Figure 11:
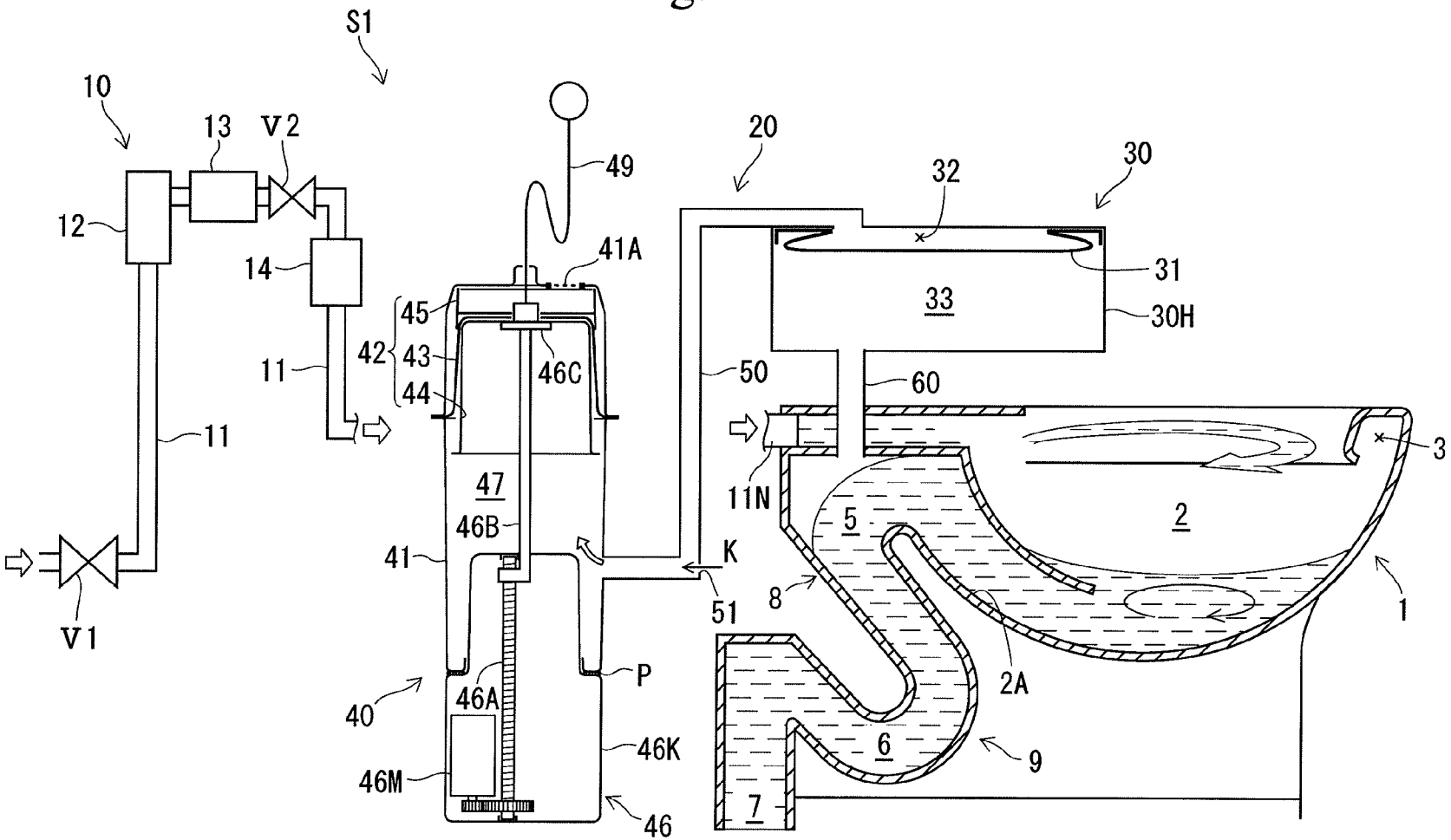
FIG. 11 is a view showing a frame format of the Western style flushing toilet of embodiment 3, showing a flushing state of the toilet.

In the Western style flushing toilet of embodiment 3, as shown in FIGS. 10 and 11, an aperture 51 which communicates between the communication conduit 50 and an atmosphere is provided in the middle of the communication conduit 50 which communicates between the first airtight chamber 47 formed in the case body 41 and the first chamber 32 of the suction tank 30. Since the other structure is the same as of the foregoing embodiment 1 and the like, the same reference symbols are affixed to the same structure and the description of structure, operation and effect will be eliminated.

In the electromagnetic drive device 40 of embodiment 3, when the electric motor 46M of the moving device 46 is driven so that the moving device 42 is moved upward, air in the first chamber 32 flows through the communication conduit 50 into the first airtight chamber 47, as shown in FIG. 11. On this occasion, air K also flows into the first airtight chamber 47 through the aperture 51 provided in the communication conduit 50 although an amount of air flowing through the aperture 51 is slight. Accordingly, the first diaphragm 31 can reliably be moved to the ascent position at a predetermined speed. Consequently, air can reliably be sucked from the toilet drain passage 5 into the second chamber 33, whereupon the siphon action is initiated so that waste or the like can be discharged out of the toilet body 1.

Furthermore, when the electric motor 46M is reverse-rotated after the set time has elapsed from the initiation of siphon action, the upwardly pressing plate 46C of the bar-like member 46B is moved downward, and the moving device 42 is also moved downward. On this occasion, since the first airtight chamber 47 communicates through the aperture 51 of the communication conduit 50 with the atmosphere, air is reliably discharged from the first airtight chamber 47 and air is reliably supplied into the first chamber 32. Accordingly, the moving member 42 and the first diaphragm 31 are reliably moved to the descent position without being stopped in the middle of the downward movement. Thus, in preparation for the next toilet flushing, the moving member 42 and the first diaphragm 31 are located at the respective lowermost positions where air can sufficiently be sucked from the toilet drain passage 5. Consequently, the toilet flushing can be repeatedly carried out successfully. Accordingly, the siphon action can also normally be initiated in the air suction device 20 of embodiment 3 irrespective of the installation location or the condition of use of the toilet body 1, whereupon the toilet flushing can be carried out successfully.

Embodiment 4

Figure 12:
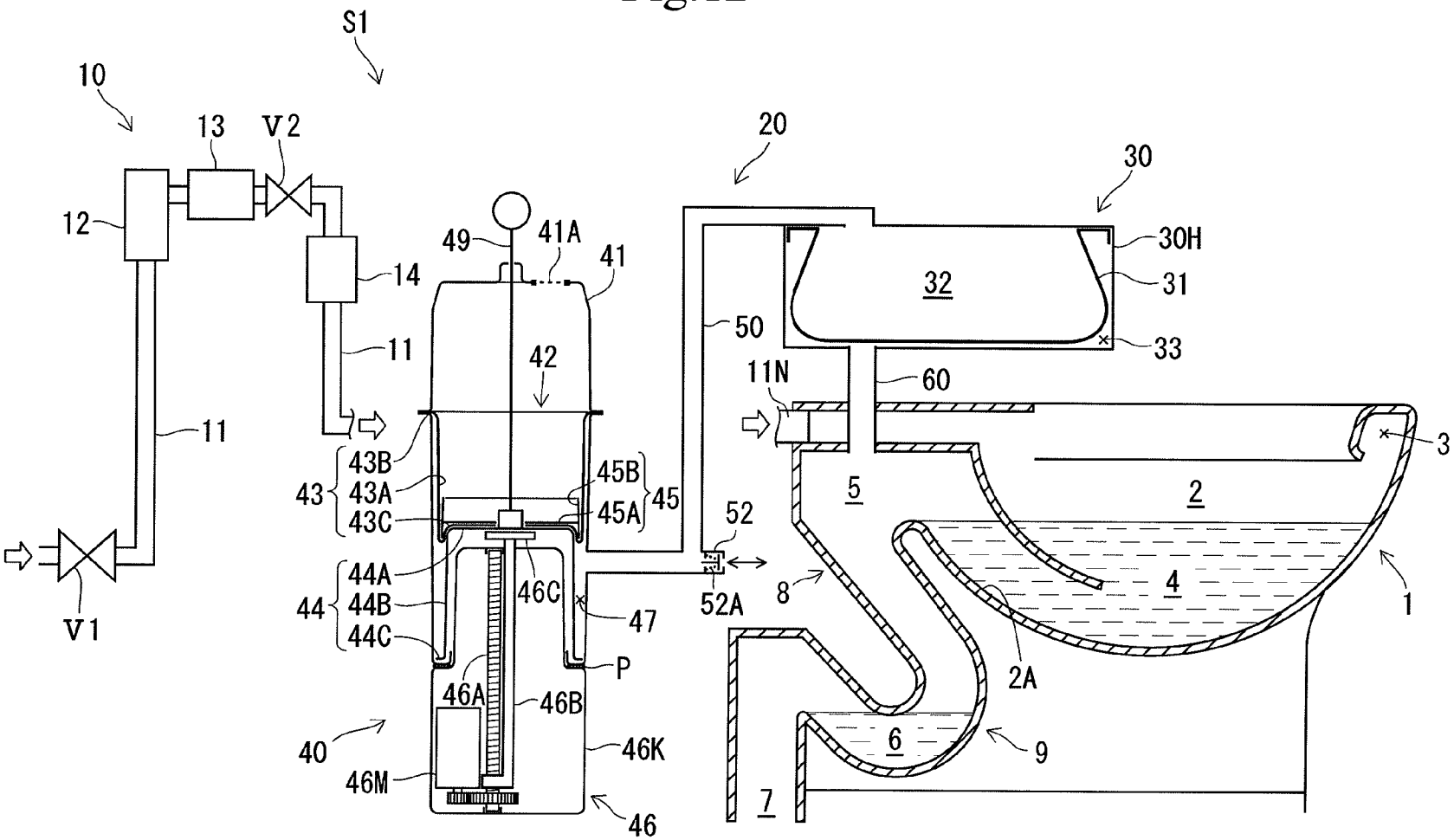
FIG. 12 is a view showing a frame format of a Western style flushing toilet of embodiment 4.
Figure 13:
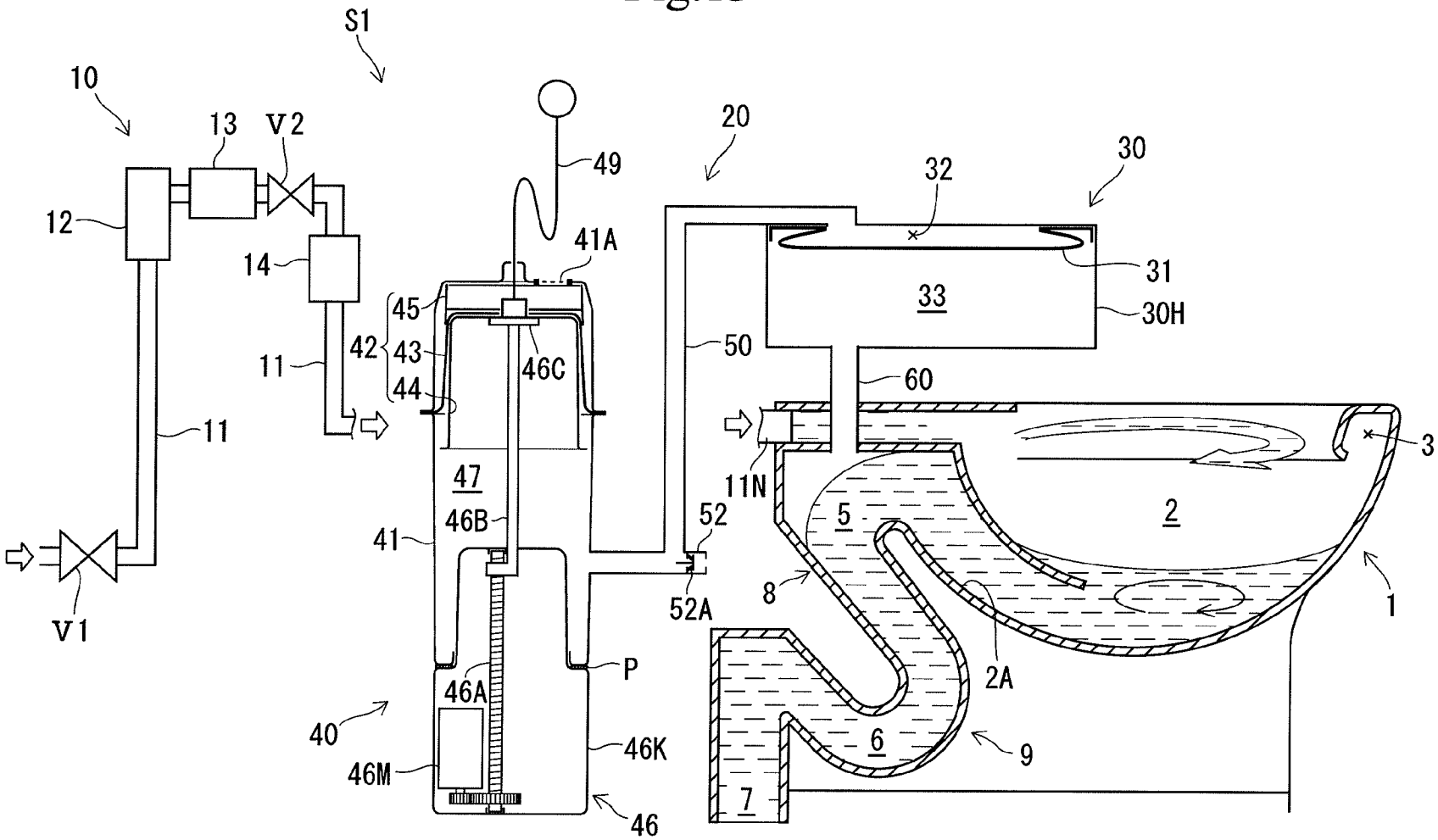
FIG. 13 is a view showing a frame format of the Western style flushing toilet of embodiment 4, showing a flushing state of the toilet.

In the Western style flushing toilet of embodiment 4, as shown in FIGS. 12 and 13, a second on-off valve 52 is provided in the middle of the communication conduit 50 which communicates between the first airtight chamber 47 formed in the case body 41 and the first chamber 32 of the suction tank 30. The second on-off valve 52 is incorporated with a spring 52A and is normally opened by the urging force of the spring 52A. The second on-off valve 52 communicates between the communication conduit 50 and the atmosphere. When the pressure in the communication conduit 50 becomes lower than the atmospheric pressure by a predetermined pressure, the second on-off valve 52 is closed against the urging force of the spring 52A so that the communication between the communication conduit 50 and the atmosphere is closed. Since the other structure is the same as of the foregoing embodiment 1 and the like, the same reference symbols are affixed to the same structure and the description of structure, operation and effect will be eliminated.

In the electromagnetic drive device 40 of embodiment 4, when the electric motor 46M of the moving device 46 is driven to press the moving member 42 upward, air in the first chamber 32 flows through the communication conduit 50 into the first airtight chamber 47, as shown in FIG. 13. On this occasion, since the cubic capacity of the first airtight chamber 47 is increased at a stroke, the pressure in the communication conduit 50 becomes lower than the atmospheric pressure by the predetermined pressure. Accordingly, the second on-off valve 52 is closed against the urging force of the spring 52A such that the communication between the communication conduit 50 and the atmosphere is closed. As a result, air in the first chamber 32 reliably flows into the first airtight chamber 47 so that the first diaphragm 31 can reliably be ascended to the ascent position at a predetermined speed. Accordingly, since air in the toilet drain passage 5 can reliably be sucked in the second chamber 33, the siphon action can be initiated and waste can be discharged out of the toilet body 1.

Furthermore, when the electric motor 46M is reverse-rotated after the set time has elapsed from the initiation of siphon action, the upwardly pressing plate 46C of the bar-like member 46B is moved downward, and the moving device 42 is also moved downward, as shown in FIG. 12. On this occasion, the pressure in the communication conduit 50 does not become lower than the atmospheric pressure. Accordingly, the second on-off valve 52 is open and the communication conduit 50 is in communication with the atmosphere. As a result, air is reliably discharged out of the first airtight chamber 47 and the interior of the first chamber 32 is reliably filled with air. Consequently, the moving member 42 and the first diaphragm 31 are reliably moved to the descent position without being stopped in the middle of descent. Thus, in preparation for the next toilet flushing, the moving member 42 and the first diaphragm 31 are located at the respective lowermost positions where air can sufficiently be sucked from the toilet drain passage 5. Consequently, the toilet flushing can be repeatedly carried out successfully.

Accordingly, the siphon action can also normally be initiated in the air suction device 20 of embodiment 4 irrespective of the installation location or the condition of use of the toilet body 1, whereupon the toilet flushing can be carried out successfully.

Furthermore, even when the inner pressure of the communication conduit 50 is slightly lower than the atmospheric pressure due to temperature changes or the like, the second on-off valve 52 is not closed such that the communication between the communication conduit 50 and the atmosphere is maintained. As a result, the first diaphragm 31 is prevented from upward movement since the inner pressure of the communication conduit 50 is rendered slightly smaller than the atmospheric pressure such that the second on-off valve 52 is closed. More specifically, the second chamber 33 can be prevented from sucking air from the toilet drain passage 5 due to temperature changes or the like, and the flush water stored in the water sealing section 4 of the toilet body 1 can be prevented from flowing into the toilet drain passage 5, whereby the water can be prevented from running out of the water sealing section 4.

Reference Example 1

Figure 14:
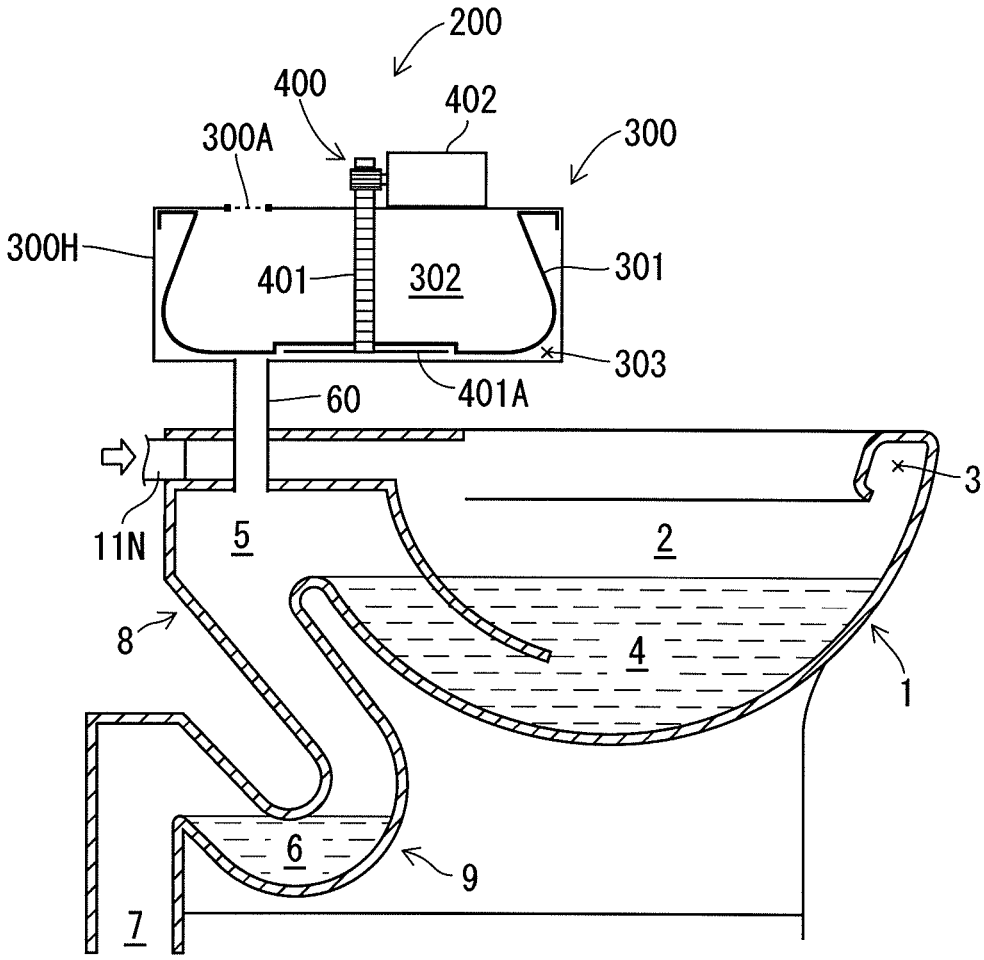
FIG. 14 is a view showing a frame format of a Western style flushing toilet of reference example 1.
Figure 15:
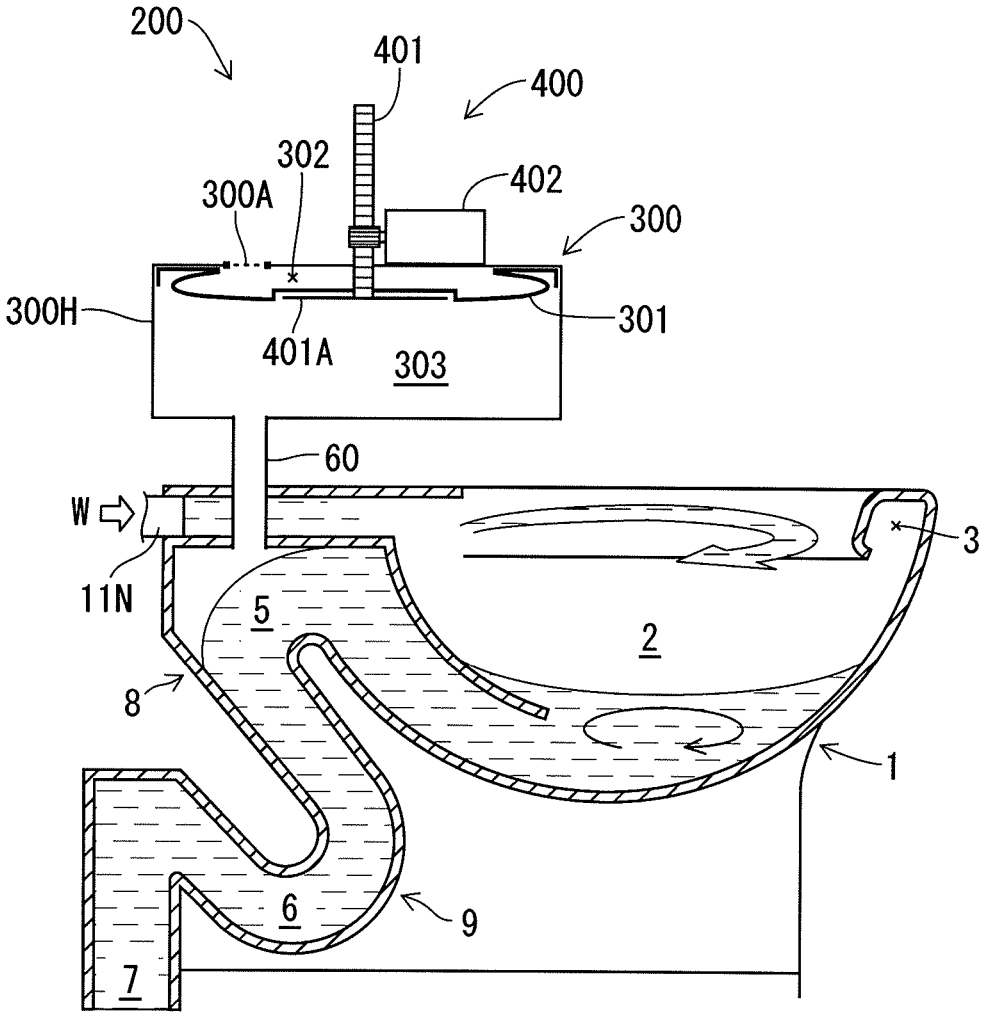
FIG. 15 is a view showing a frame format of the Western style flushing toilet of reference example 1, showing a flushing state of the toilet.

In the Western style flushing toilet of reference example 1, as shown in FIGS. 14 and 15, the air suction device 200 has a different structure. Since the other structure is the same as of the foregoing embodiment 1 and the like, the same reference symbols are affixed to the same structure and the description of structure, operation and effect will be eliminated. Additionally, since the flush water supply device 10 is the same as in the foregoing embodiment 1 and the like, the flush water supply device 10 is eliminated in the drawings.

The air suction device 200 in reference example 1 includes a suction tank 300 provided with a first diaphragm 301 which is placed in a housing 300H so as to be vertically movable at an installed position and an electromagnetic drive device 400 which moves the first diaphragm 301 upward.

An interior of the suction tank 300 is partitioned by a first diaphragm 301 into an upper first chamber 302 and a lower second chamber 303. The second chamber 303 has airtightness. The first chamber 302 is open through an opening 300A to the atmosphere. A filter is attached to the opening 300A so that trash or the like can be prevented from entering into the first chamber 302. Furthermore, the second chamber 303 communicates through a suction conduit 60 with the toilet drain passage 5.

The electromagnetic drive device 400 has a connecting member 401 having a lower end connected to a disc-like upwardly pressing plate 401A bonded to the central underside of the first diaphragm 301. The connecting member 401 is provided with a rack gear. Furthermore, the electromagnetic drive device 400 has an electric motor 402 fixed to an upper face of the housing 300H. The electric motor 402 drives a pinion gear which moves the connecting member 401 vertically.

Toilet flushing by the Western style flushing toilet of reference example 1 will be carried out as follows. A predetermined amount of flush water is supplied from the flush water supply device 10 to the toilet bowl 2 in the same manner as in embodiment 1. The electromagnetic drive device 400 is driven in synchronization with reach of a sufficient high water level in the toilet bowl 2. More specifically, as shown in FIG. 15, the electric motor 402 is driven so that the connecting member 401 is moved upward to a predetermined level at a predetermined speed. As a result, the first diaphragm 301 is moved upward to the predetermined level at the predetermined speed. On this occasion, since the air in the toilet drain passage 5 is sucked into the second chamber 303, flush water is caused to flush into the toilet drain passage 5 swiftly and a strong siphon action is initiated, whereupon waste or the like is discharged out of the toilet body 1.

Furthermore, the electric motor 402 is reverse-rotated after elapse of the set time from the initiation of siphon action so that the connecting member 401 is moved downward thereby to move the first diaphragm 301 downward. On this occasion, air is discharged from the second chamber 303 into the toilet drain passage 5, whereby the flush water in the toilet drain passage 5 is caused to flow into the water sealing section 4 side and the dwell section 6 side. Accordingly, the flow of flush water in the toilet drain passage 5 is divided, whereby the siphon action is ended. Thereafter, flush water is supplied from the flush water supply device 10 into the toilet bowl 2 so that water sealing with a predetermined water level is provided, whereby the toilet flushing is completed.

Since the air suction device 200 of the toilet drain passage 5 in reference example 1 can directly move the first diaphragm 301 upward by the connecting member 401, the state of air suction from the toilet drain passage 5 is not varied, and flush water can be caused to flush from the water sealing section 4 into the toilet drain passage 5 swiftly. Accordingly, a strong siphon action can reliably be initiated, and waste can be discharged out of the toilet body 1. As a result, the saving of flush water can be facilitated.

Accordingly, the air suction device 200 of reference example 1 can normally initiate the siphon action and carry out the toilet flushing successfully irrespective the installation location of the toilet body 1 or the condition of use.

Furthermore, the air suction device 200 for the toilet drain passage 5 in reference example 1 can be rendered smaller in size since the structure of the air suction device 200 can be simplified. Additionally, since the first diaphragm 301 is directly moved by the connecting member 401, a moving speed and an amount of movement of the first diaphragm 301 can be realized with high accuracy. More specifically, a suction speed at which air is sucked from the toilet drain passage 5 and an amount of sucked air can be realized with high accuracy when set according to the shape of the toilet body 1 and the type such as the capacity of the toilet drain passage 5. Accordingly, the air suction device 200 can easily be applied to a plurality of types of Western style flushing toilets.

Although the embodiments 1 to 4 in accordance with the present invention have been described above, the invention should not be limited to the foregoing embodiments but may be changed in application without departing from the scope thereof.

(1) For example, in each of embodiments 1 to 4, the electric motor may be controlled so that an upward movement speed of the first diaphragm is changed. More specifically, the electric motor may be controlled so that the upward movement speed of the first diaphragm is increased until a specified time elapses from the start of air suction from the toilet drain passage by the air suction device, whereby the air suction force from the toilet drain passage is increased. Subsequently, the electric motor is controlled so that the upward movement speed of the first diaphragm is reduced, whereby the air suction force from the toilet drain passage is reduced. Consequently, the siphon action can reliably be initiated until the specified time elapses from the start of air suction from the toilet drain passage by the air suction device, whereby weighty waste can be discharged out of the toilet body. Subsequently, the siphon action is continued so that lightweight waste can be discharged out of the toilet body.

(2) In embodiments 1 to 4, various types of chain, wires, organic fiber ropes and the like may be employed as the pulling member.

(3) In embodiments 1 to 4, the moving member may be a columnar piston. In this case, the structure of the moving member can be simplified, and the size of the electromagnetic drive device can be reduced.

(4) In embodiment 4, the spring of the second on-off valve may be eliminated. In this case, the second on-off valve closes communication between the communication conduit and the atmosphere when the pressure in the communication conduit is reduced below the atmospheric pressure. As a result, since air in the first chamber is reliably caused to flow into the first airtight chamber during the toilet flushing such that the first diaphragm can reliably be ascended to the ascent position, air can reliably be sucked from the toilet drain passage, whereupon the siphon action can reliably be initiated.

(5) In embodiment 4, the valve element of the second on-off valve can be spherical in shape. In this case, the spring need not be incorporated.

Reference Example 2

Figure 16:
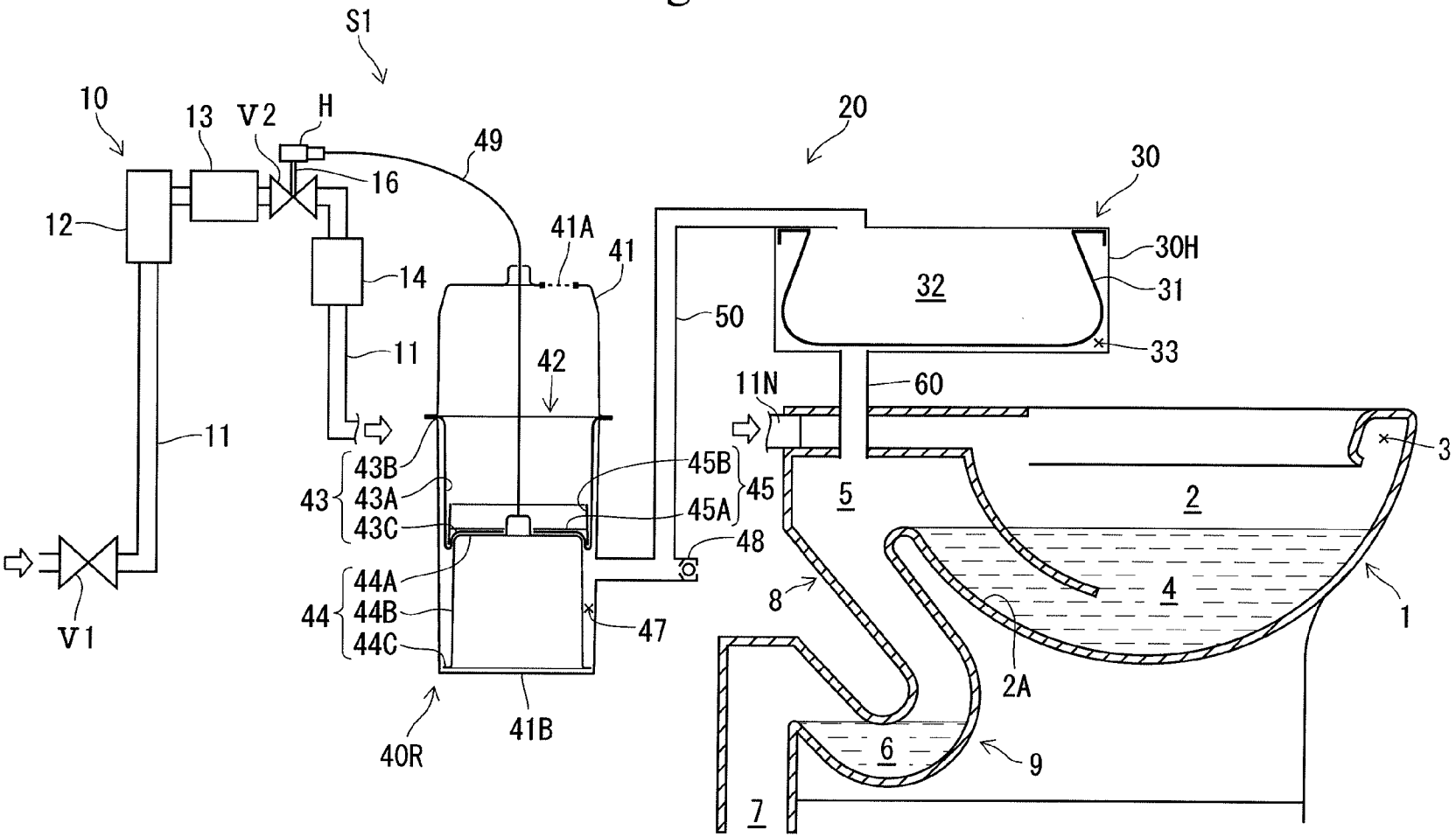
FIG. 16 is a view showing a frame format of a Western style flushing toilet of reference example 2.
Figure 17:
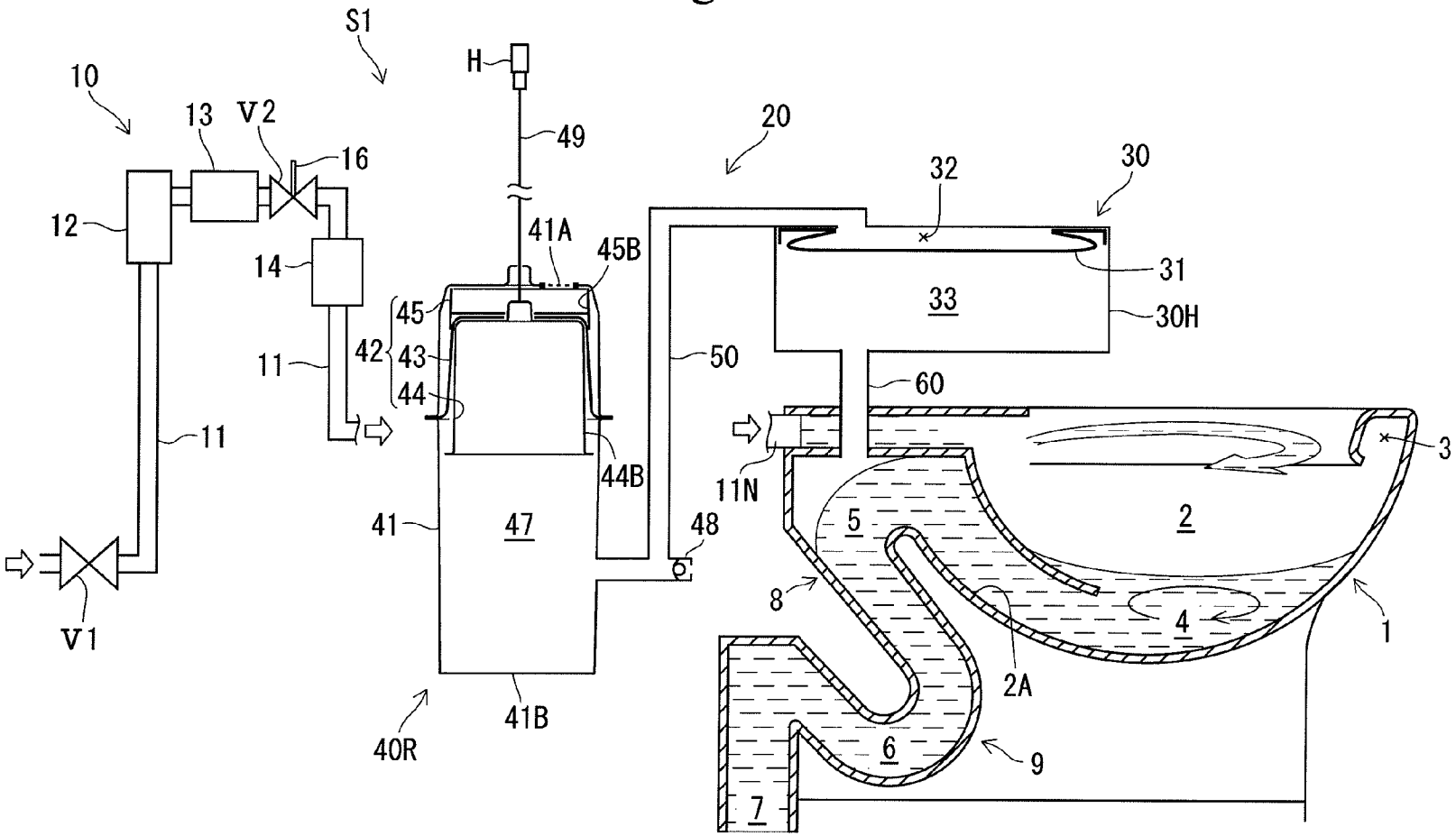
FIG. 17 is a view showing a frame format of the Western style flushing toilet of the reference example 2, showing a flushing state of the toilet.

A Western style flushing toilet is shown as a reference example 2 in FIGS. 16 and 17. In this flushing toilet, the lower end of the case body 41 of the drive device 40R is closed by the bottom wall 41B, and the moving device 46 is not provided. Since the other structure is the same as of the foregoing embodiments 1 to 4, the same reference symbols are affixed to the same structure and the description of structure, operation and effect will be eliminated.

The toilet flushing of the Western style flushing toilet of the reference example 2 can be carried out by manually operating the flushing handle H by the user so that the ball chain 49 is pulled upward or in like manner when the electric motor 46M cannot be driven due to electric power failure or the like as in embodiment 1.

Accordingly, the air suction device 20R of the reference example 2 can normally initiate the siphon action and carry out the toilet flushing successfully irrespective the installation location of the toilet body 1 or the condition of use.

The invention claimed is:

1. An air suction device for a toilet drain passage, which sucks air from a toilet drain passage connected to a downstream side of a water sealing section of a toilet body, the air suction device comprising:

a suction tank provided with a first diaphragm which is placed in a housing so as to be vertically movable at an installed position, the suction tank being partitioned by the first diaphragm into an upper first chamber and a lower second chamber which communicates with the toilet drain passage; and an electromagnetic drive device which moves the first diaphragm upward, wherein;

the electromagnetic drive device has a cylindrical case body installed away from the suction tank and extending vertically at an installed position, a moving member which is housed in the case body so as to be vertically movable, and a moving device provided on a lower end of the case body;

the moving device has a casing and an actuator which is assembled in the casing to move the moving member;

the case body is provided with a first airtight chamber surrounded by the moving member and the moving device in the case body, the first airtight chamber having a cubic capacity that is changed by movement of the moving member and communicating via a communication conduit with the first chamber; and the first airtight chamber sucks air in the first chamber to move the first diaphragm upward.

2. The air suction device according to claim 1, wherein the moving member has:

a second diaphragm including a cylindrical portion extending vertically along an inner circumferential surface of the case body, a flange extending outward from one of two ends of the cylindrical portion and fixed to the inner circumferential surface of the case body and a central part extending inward from the other end of the cylindrical portion; and a guide mounted on the central part of the second diaphragm to guide the central part so that the central part is moved vertically while being maintained in a horizontal state.

3. The air suction device according to claim 2, wherein:

the case body has a lower end opening through which an upper part of the moving device is inserted;

the guide is formed by an upper wall mounted to a central underside of the second diaphragm, a side wall extending downward from a peripheral edge of the upper wall and then along the inner circumferential surface of the case body, and a flange extending outward from an outer circumferential edge of a lower end of the side wall; and the guide can house an upper part of the moving device when having been moved downward.

4. The air suction device according to claim 3, wherein the moving member is connected to a pulling member drawn out of the case body and pulling the moving member upward.

5. The air suction device according to claim 4, wherein the pulling member is vertically inserted through a guide member located higher than the case body thereby to be guided.

6. The air suction device according to claim 2, wherein the moving member is connected to a pulling member drawn out of the case body and pulling the moving member upward.

7. The air suction device according to claim 6, wherein the pulling member is vertically inserted through a guide member located higher than the case body thereby to be guided.

8. The air suction device according to claim 1, wherein the moving member is connected to a pulling member drawn out of the case body and pulling the moving member upward.

9. The air suction device according to claim 8, wherein the pulling member is vertically inserted through a guide member located higher than the case body thereby to be guided.

10. The air suction device according to claim 1, wherein the casing defines a second airtight chamber therein, and the casing is provided with a communication hole which communicates between the first and second airtight chambers, and said air suction device further comprising a first on-off valve which communicates between the second airtight chamber and an atmosphere when the actuator is in a standby state and which closes communication between the second airtight chamber and the atmosphere when the actuator is in a drive state.

11. The air suction device according to claim 1, wherein the communication conduit is provided with an aperture which communicates between the communication conduit and an atmosphere.

12. The air suction device according to claim 1, wherein the communication conduit is provided with an on-off valve which normally communicates between the communication conduit and an atmosphere and which closes communication between the communication conduit and the atmosphere when pressure in the communication conduit is lower than an atmospheric pressure.

* * * * *